US009862192B2

(12) United States Patent
Ogawa

(10) Patent No.: US 9,862,192 B2
(45) Date of Patent: Jan. 9, 2018

(54) LIQUID JETTING APPARATUS

(71) Applicant: BROTHER KOGYO KABUSHIKI KAISHA, Nagoya-shi, Aichi-ken (JP)

(72) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/281,356

(22) Filed: Sep. 30, 2016

(65) Prior Publication Data

US 2017/0087846 A1 Mar. 30, 2017

(30) Foreign Application Priority Data

Sep. 30, 2015 (JP) ..... 2015-195359

(51) Int. Cl.
*B41J 2/165* (2006.01)

(52) U.S. Cl.
CPC ..... *B41J 2/16508* (2013.01); *B41J 2/16505* (2013.01); *B41J 2/16511* (2013.01); *B41J 2/16523* (2013.01)

(58) Field of Classification Search
CPC ..... B41J 2/165; B41J 2/16505
See application file for complete search history.

(56) References Cited

U.S. PATENT DOCUMENTS 7,451,975 B2 11/2008 Cook et al.
8,523,168 B2 9/2013 Samoto et al.
2007/0076036 A1 4/2007 Koga et al.
2008/0157460 A1 7/2008 Izuchi et al.
2009/0035018 A1 2/2009 Koga et al.
2009/0035019 A1 2/2009 Koga et al.
2009/0243186 A1 10/2009 Samoto
(Continued)

FOREIGN PATENT DOCUMENTS

CN 101357546 A 2/2009
JP H08-169125 A 7/1996
(Continued)

OTHER PUBLICATIONS

Japanese Office Action dated May 1, 2012 issued in JP 2010-138801.
(Continued)

*Primary Examiner* — Sharon A Polk
(74) *Attorney, Agent, or Firm* — Scully, Scott, Murphy & Presser, PC

(57) ABSTRACT

A liquid jetting apparatus includes: a head unit including a liquid jetting surface with nozzles; a cap movable between a capping position and an uncapping position; a cap movement device allowing the cap to reciprocate; a driven device; a drive motor driving the cap movement device and the driven device; a first gear transmitting power from the drive motor to the cap movement device; a second gear transmitting the power from the drive motor to the driven device; a switch gear which is moved by the power from the drive motor between a position in which the switch gear engages with the first gear and a position in which the switch gear engages with the second gear; a gear movement device moving the switch gear; a sensor outputting a signal according to driving of the cap movement device; and a controller.

12 Claims, 24 Drawing Sheets

(56) References Cited

U.S. PATENT DOCUMENTS

| | | | | |
|---|---|---|---|---|
| 2009/0256874 | A1* | 10/2009 | Samoto | B41J 29/38 347/9 |
| 2010/0045724 | A1 | 2/2010 | Toki | |
| 2010/0157328 | A1* | 6/2010 | Hoshino | B41J 2/16532 358/1.8 |
| 2011/0310174 | A1 | 12/2011 | Samoto et al. | |

FOREIGN PATENT DOCUMENTS

| | | | | |
|---|---|---|---|---|
| JP | 2002-249248 | A | | 9/2002 |
| JP | 2007-090800 | A | | 4/2007 |
| JP | 2008-162736 | A | | 7/2008 |
| JP | 2009-034847 | A | | 2/2009 |
| JP | 4277902 | B2 | | 6/2009 |
| JP | 2009-242100 | A | | 10/2009 |
| JP | 2010-047382 | A | | 3/2010 |
| JP | 2012-011549 | A | | 1/2012 |
| JP | 2012121310 | A | * | 6/2012 |
| JP | 5099178 | B2 | | 12/2012 |

OTHER PUBLICATIONS

Chinese Office Action dated Jun. 8, 2013 issued in CN 201110078851.4.

* cited by examiner

LEFT ⟷ RIGHT
SCANNING DIRECTION

LIQUID JETTING APPARATUS

CROSS REFERENCE TO RELATED APPLICATION

The present application claims priority from Japanese Patent Application No. 2015-195359 filed on Sep. 30, 2015, the disclosure of which is incorporated herein by reference in the entirety.

BACKGROUND OF THE INVENTION

Field of the Invention

The present invention relates to a liquid jetting apparatus configured to jet liquid from nozzles.

Description of the Related Art

As a liquid jetting apparatus jetting liquid from nozzles, there is known a multifunction peripheral with a print unit which jets ink from nozzles to perform recording on a recording sheet. The print unit includes a carriage which reciprocates while carrying a recording head. The movement of the carriage moves first and second switch gears connected to an ASF motor to switch engagements between the first and second switch gears and any of first to third transmission gears. Driving the ASF motor with the second switch gear engaging with the third transmission gear rotates a first feed roller or a second feed roller, thereby feeding the recording sheet. Driving the ASF motor with the second switch gear engaging with the second transmission gear raises a nozzle cap for covering the recording head.

SUMMARY

In the above print unit, in order to prevent the ink in nozzles from drying, the recording head is typically covered with the nozzle cap when no recording is performed on the recording sheet. In this situation, the second switch gear engages with the second transmission gear. To perform recording on the recording sheet, the nozzle cap is separated from the recording head to allow the carriage to reciprocate. The carriage is moved to move the first and second switch gears, switching the second switch gear from a state in which it engages with the second transmission gear to a state in which it engages with the third transmission gear. Then, the ASF motor is driven to feed the recording sheet. The second switch gear, unfortunately, may strongly engage with the second transmission gear. In that case, when the second switch gear attempts to engage with the third transmission gear, the second switch gear may remain engaged with the second transmission gear. If the ASF motor is driven with the second switch gear erroneously engaging with the second transmission gear, the nozzle cap is moved upward. This may cause the carriage to hit or collide with the nozzle cap, breaking ink meniscuses in nozzles when the carriage returns to a position where the carriage faces the nozzle cap.

An object of the present teaching is to provide a liquid jetting apparatus capable of preventing a cap from erroneously moving to a capping position which would be otherwise caused by the failure of switching of gears.

According to a first aspect of the present teaching, there is provided a liquid jetting apparatus, including:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear configured to transmit the power which is generated by rotating the drive motor in the predetermined direction to the driven device;

a switch gear to which the power from the drive motor is transmitted, the switch gear being configured to be moved between a first position in which the switch gear engages with the first gear and a second position in which the switch gear engages with the second gear;

a gear movement device configured to move the switch gear;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and stop the drive motor in a case that the controller detects the driving of the cap movement device.

According to a second aspect of the present teaching, there is provided a liquid jetting apparatus, including:

a head unit including nozzles and a liquid jetting surface with the nozzles;

a cap configured to be moved, between a capping position in which the cap makes contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear disposed side by side with the first gear in a scanning direction and configured to transmit power which is generated by rotating the drive motor in the predetermined direction to the driven device;

a switch gear to which power from the drive motor is transmitted, is the switch gear being configured to be moved, in the scanning direction, between a first position in which the switch gear engages with the first gear and a second position in which the switch gear engages with the second gear;

a gear movement device configured to move the switch gear in the scanning direction;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and rotate the drive motor in the predetermined direction and a direction opposite to the predetermined direction repeatedly and alternately to eliminate strong engagement between the switch gear and the first gear, in a case that the controller detects the driving of the cap movement device.

In the case that the drive motor is controlled to drive the cap movement device with the cap being in the capping position, the controller of the present teaching detects the driving of the cap movement device after the driving of the cap movement device is started and before the cap reaches the capping position, based on the signal inputted from the sensor. Under the condition that the controller drives the gear movement device so that the switch gear moves from the first position to the second position and then rotates the drive motor in the predetermined direction, and in the case that the controller detects the driving of the cap movement device based on the signal from the sensor, the controller stops the drive motor or rotates the drive motor in the predetermined direction and the direction opposite to the predetermined direction repeatedly and alternately. According to the present teaching, even when the switch gear remains engaged with the first gear due to the failure of movement of the switch gear from the first position to the second position, the cap is prevented from moving to the capping position.

DESCRIPTION OF THE EMBODIMENTS

Preferred embodiments of the present teaching will be described below.

<Overall Configuration of Printer>

Figure 1:
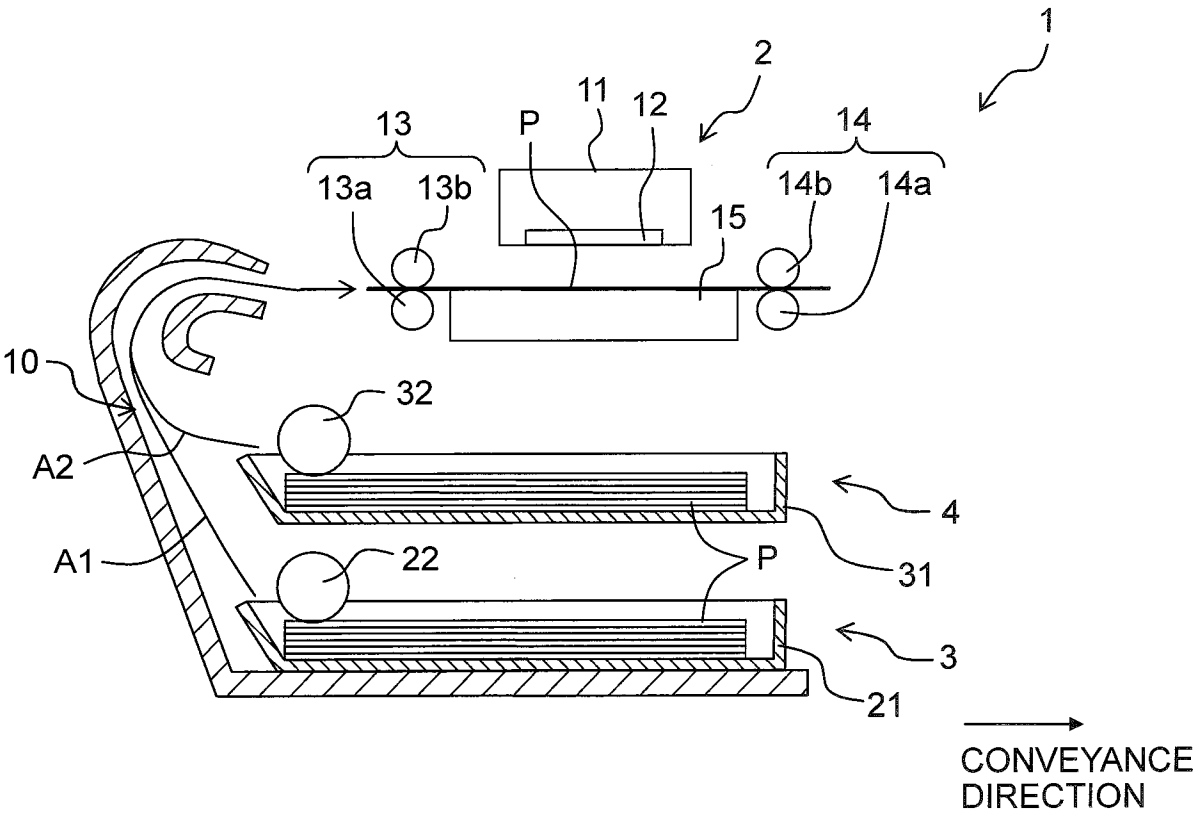
FIG. 1 is a schematic side view of a printer according to an embodiment of the present teaching.
Figure 2:
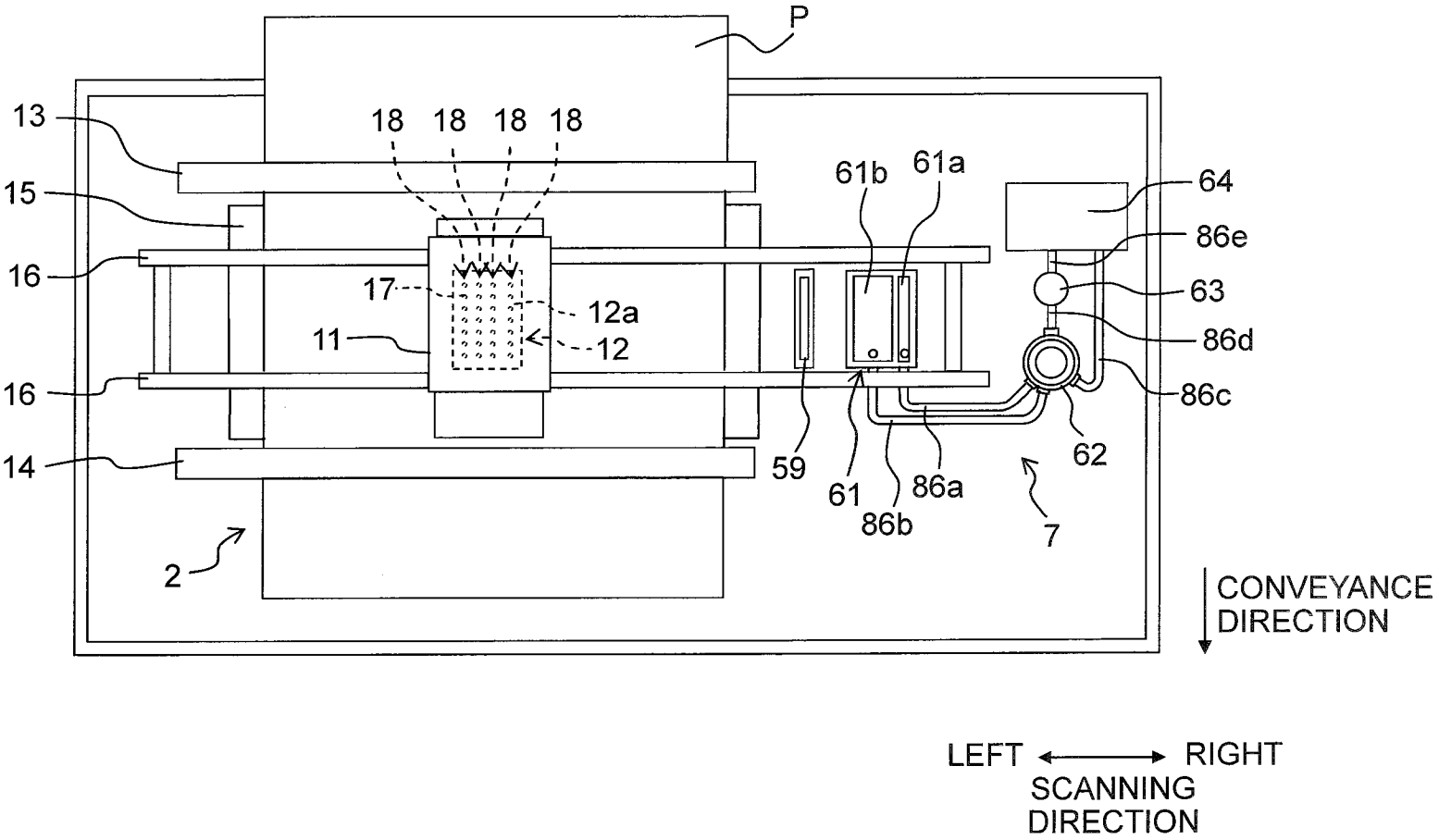
FIG. 2 is a schematic plan view of a print unit and a maintenance unit.

As depicted in FIGS. 1 and 2, a printer 1 of this embodiment includes, for example, a print unit 2, a lower cassette feed part 3, an upper cassette feed part 4, and a maintenance unit 7.

<Print Unit>

The print unit 2 includes, for example, a carriage 11, an ink-jet head 12 (a "liquid jetting head" of the present teaching), conveyance rollers 13, 14, and a platen 15. The carriage 11 is movably supported in a scanning direction by two guide rails 16 extending in the scanning direction. The carriage 11, which is connected to a carriage motor 156 (see FIG. 17) via an unillustrated belt and pulley, is driven by the carriage motor 156 so as to reciprocate in the scanning direction. In the following, the right and the left in the scanning direction are defined as indicated in FIG. 2.

The ink-jet head 12, which is carried on the carriage 11, jets ink from nozzles 17 formed in an ink jetting surface 12*a* which is a lower surface of the ink-jet head 12. The nozzles 17, which are disposed to align in a conveyance direction orthogonal to the scanning direction, form nozzle rows 18. The ink-jet head 12 includes four nozzle rows 18 arranged in the scanning direction. Inks of black, yellow, cyan, and magenta are jetted from the nozzles 17 of the four nozzle rows 18 respectively, in the order of the nozzle rows 18 from the right side in the scanning direction. The carriage 11 and the ink-jet head 12 correspond to a "head unit" of the present teaching.

The conveyance rollers 13 are disposed upstream of the carriage 11 in the conveyance direction, which is parallel to the ink jetting surface 12*a* and orthogonal to the scanning direction. The conveyance rollers 13 include a drive roller 13*a* and a driven roller 13*b* disposed on the upper side of the drive roller 13*a*. As will be described later, the drive roller 13*a* is connected to a PF motor 101 (see FIG. 13). Driving the PF motor 101 reversely (counterclockwise) transmits power from the PF motor 101 to the drive roller 13*a*, thereby rotating the drive roller 13*a* in a clockwise direction in FIG. 1. This conveys a recording sheet P in the conveyance direction in a state that the sheet P is nipped by the drive roller 13*a* and the driven roller 13*b*. Driving the PF motor 101 normally (clockwise) rotates the drive roller 13*a* in a counterclockwise direction in FIG. 1.

The conveyance rollers 14 are disposed downstream of the carriage 11 in the conveyance direction. The conveyance rollers 14 include a drive roller 14*a* and a driven roller 14*b* disposed on the upper side of the drive roller 14*a*. The drive roller 14*a* is connected to the drive roller 13*a* via unillustrated gears. Thus, when power is transmitted from the PF motor 101 to the drive roller 13*a*, drive force is transmitted also to the drive roller 14*a* to rotate the drive roller 14*a*. In this situation, the drive rollers 13*a*, 14*a* have the same rotation direction. Accordingly, rotating the PF motor 101 reversely (counterclockwise) conveys the recording sheet P in the conveyance direction in a state that the recording sheet P is nipped by the drive roller 14*a* and the driven roller 14*b*.

The platen 15 is disposed between the conveyance rollers 13, 14 in the conveyance direction to face the ink jetting surface 12*a*. The platen 15 supports, from below, the recording sheet P conveyed by the conveyance rollers 13, 14.

<Lower Cassette Feed Part>

The lower cassette feed part 3 is disposed below the platen 15. The lower cassette feed part 3 includes a sheet cassette 21 and a feed roller 22 (a "driven device" and a "first sheet supply device" of the present teaching). The sheet cassette 21 accommodates recording sheets P (a "first sheet" of the present teaching) stacked vertically. As will be described later, the feed roller 22 is connectable to the ASF motor 102 (see FIG. 14, a "drive motor" of the present teaching) via gears including a lower feed gear 131 (see FIG. 14, a "first sheet supply gear" of the present teaching, and illustration of the gears is omitted except for the lower feed gear 131). Rotating the ASF motor 102 normally ("rotating the drive motor in a predetermined direction" of the present teaching) in a state that the feed roller 22 is connected to the ASF motor 102 transmits power from the ASF motor 102 to the feed roller 22 to rotate the feed roller 22 in the clockwise direction in FIG. 1. This rotation conveys the recording sheet P accommodated in the feed cassette 21 toward the upstream side in the conveyance direction. A supply route 10 is provided upstream of the feed cassette 21 in the conveyance direction to guide the recording sheet P fed from the downstream side in the conveyance direction to a position upstream of the conveyance roller 13 in the conveyance direction. The recording sheet P conveyed by the feed roller 22 is conveyed upstream of the conveyance roller 13 in the conveyance direction along the supply route 10 and then supplied to the print unit 2, as indicated by an arrow A1 in FIG. 1.

<Upper Cassette Feed Part>

The upper cassette feed part 4 is disposed between the platen 15 and the lower cassette feed part 3. The upper cassette feed part 4 includes a sheet cassette 31 and a feed roller 32 (the "driven device" and a "second sheet supply device" of the present teaching). The sheet cassette 31, which has substantially the same structure as that of the sheet cassette 21, accommodates recording sheets P (a "second sheet" of the present teaching) stacked vertically. As will be described later, the feed roller 32 is connectable to the ASF motor 102 via gears including an upper feed gear 132 (see FIG. 14, a "second sheet supply gear" of the present teaching, and illustration of the gears is omitted except for the upper feed gear 132). Rotating the ASF motor 102 reversely ("rotating the drive motor in a direction opposite to the predetermined direction" of the present teaching) in a state that the feed roller 32 is connected to the ASF motor 102 transmits power from the ASF motor 102 to the feed roller 32 to rotate the feed roller 32 in the clockwise direction in FIG. 1. This rotation conveys the recording sheet P accommodated in the feed cassette 31 toward the upstream side in the conveyance direction along the supply route 10 and then supplies it to the print unit 2, as depicted by an arrow A2 depicted in FIG. 1.

<Maintenance Unit>

Subsequently, the maintenance unit 7 will be explained. As depicted in FIGS. 2 to 9, the maintenance unit 7 includes a wiper 59, a cap unit 61, a switch valve 62, a suction pump 63, and a waste liquid tank 64.

<Wiper>

The wiper 59 is disposed on the right of the platen 15. The wiper 59 is moved up and down by a wiper lifting unit 157 (see FIG. 17). The upper end of the wiper 59 is positioned above the ink jetting surface 12*a* in a state that the wiper 59 is raised by the wiper lifting unit 157. When the carriage 11 moves in a state of facing the raised wiper 59, the wiper 59 makes contact with the ink jetting surface 12*a*. Meanwhile, the upper end of the wiper 59 is positioned below the ink jetting surface 12*a* in a state that the wiper 59 is lowered by the wiper lifting unit 157. When the carriage 11 moves in a state of facing the lowered wiper 59, the wiper 59 does not make contact with the ink jetting surface 12*a*.

<Cap Unit>

The cap unit 61, which is made of a rubber material etc, is disposed on the right of the wiper 59 in the scanning direction. The cap unit 61 includes two nozzle caps 61*a* and 61*b* formed integrally. The nozzle caps 61*a*, 61*b* are disposed adjacent to each other such that the nozzle cap 61*a* is on the right side of the nozzle cap 61*b* in the scanning direction. When the carriage 11 moves to a position where the ink jetting surface 12*a* faces the cap unit 61 (hereinafter referred to as a "facing position"), the rightmost nozzle row 18 overlaps the nozzle cap 61*a* and three nozzle rows 18 on the left of the rightmost nozzle row 18 overlap the nozzle cap 61*b*. The cap unit 61 is moved up and down ("movable in a cap movement direction" of the present teaching) by the cap lifting mechanism 66 (a "cap movement device" of the present teaching). When the cap lifting mechanism 66 moves the cap unit 61 upward in a state that the ink jetting surface 12*a* faces the cap unit 61, the cap unit 61 makes contact with the ink jetting surface 12*a* so that the nozzle cap 61*a* covers the rightmost nozzle row 18 and the nozzle cap 61*b* covers the three nozzle rows 18 on the left side of the rightmost nozzle row 18.

<Cap Lifting Mechanism>

Figure 3:
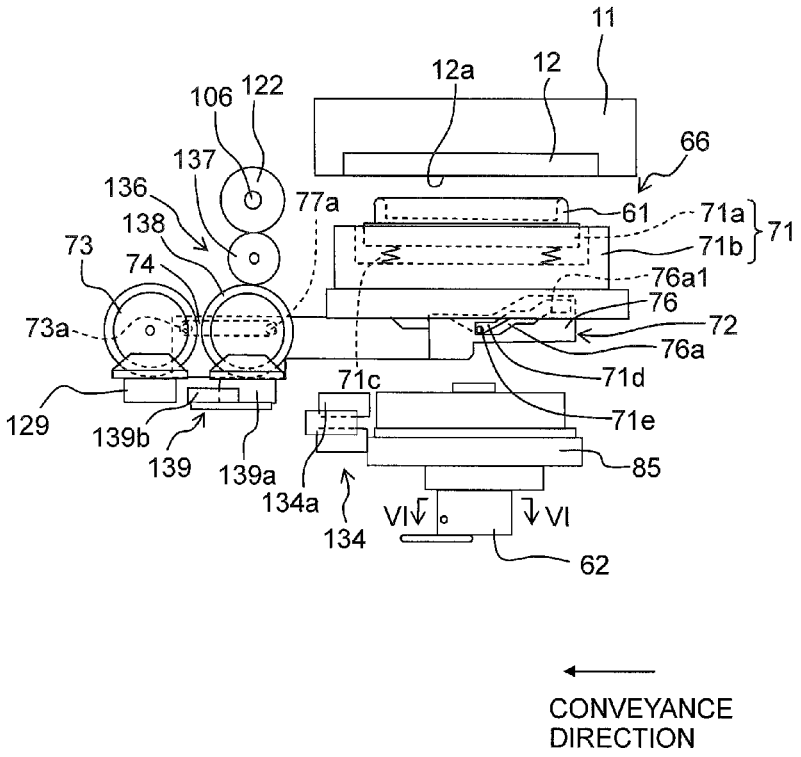
FIG. 3 depicts a cap lifting mechanism, a switch valve, and an arrangement of gears to be connected to them as viewed from the right in a scanning direction.
Figure 4A:
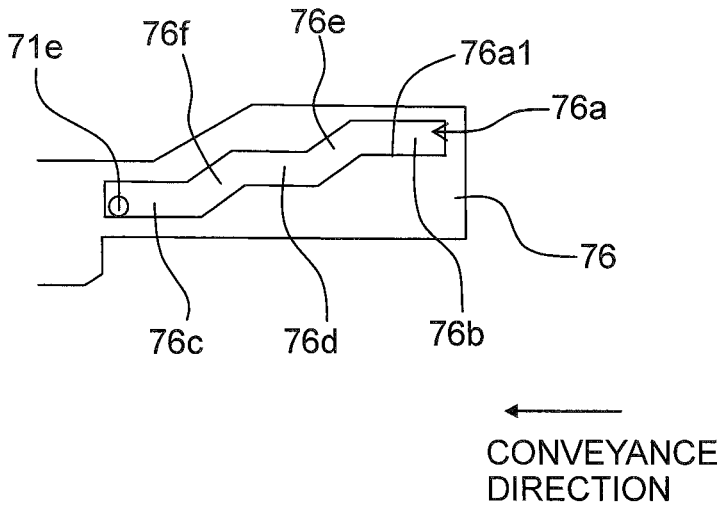
FIG. 4A is an enlarged view depicting surroundings of a groove of a slider of FIG. 3, and FIGS. 4B and 4C each depicts a positional relation between a planet gear mechanism and a bevel gear and a valve drive gear as viewed from above, FIG. 4B depicting a state in which a planet gear engages with the bevel gear, FIG. 4C depicting a state in which the planet gear engages with the valve drive gear.
Figure 4B:
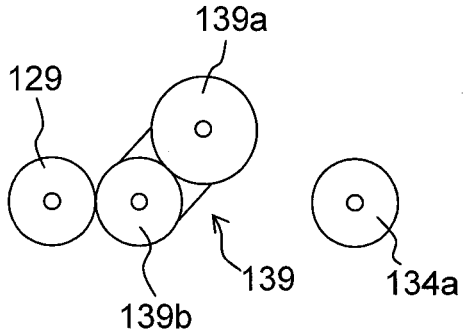
Figure 4C:
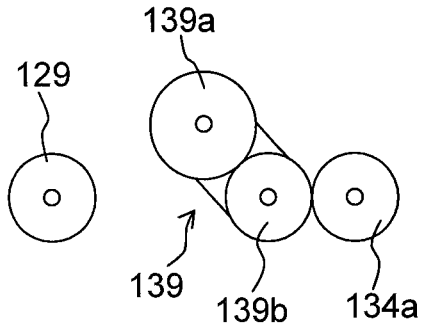
Figure 5:
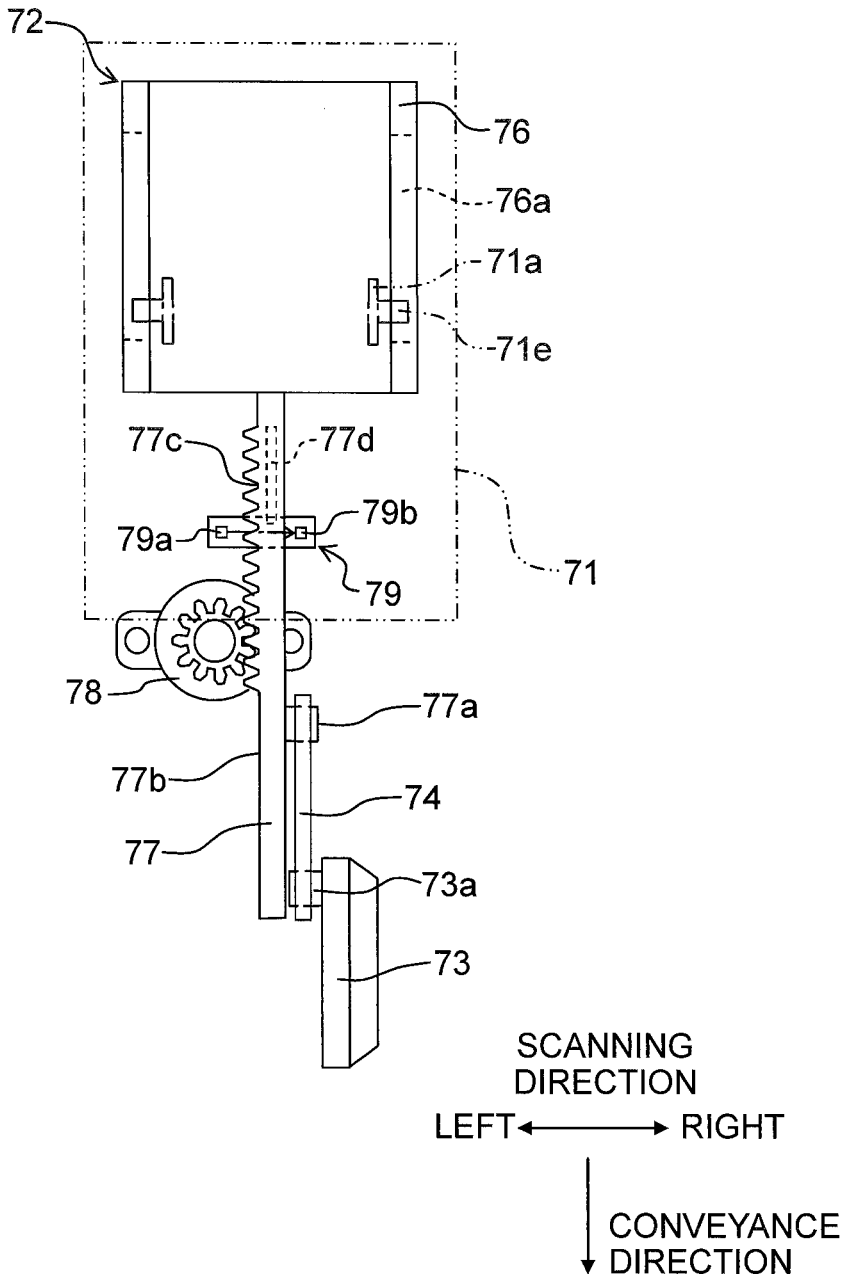
FIG. 5 is a plan view of the slider.

As depicted in FIGS. 3 to 5, the cap lifting mechanism 66 includes a cap holding part 71, a slider 72 (a "cam" of the present teaching), a crank gear 73, and an arm 74. The cap holding part 71 includes a cap holder 71*a* and a lifting member 71*b*. The cap holder 71*a*, which supports the cap unit 61 from below, increases the rigidity of the cap unit 61. The lifting mechanism 71*b*, which accommodates the cap holder 71*a*, is supported to be movable up and down by an unillustrated guide. A spring 71*c* is disposed between the cap holder 71*a* and the lifting mechanism 71*b*. The spring 71*c* biases the cap holder 71*a* upward. Protruding parts 71 d protruding downward are provided in the vicinities of both ends of the lower surface of the lifting member 71*b* in the scanning direction. Projections 71*e* (a "sliding part" of the present teaching) projecting in the scanning direction are formed in the outer side surfaces of the protruding parts 71*d* in the scanning direction, respectively.

The slider 72 includes two parts 76 and 77. The part 76 is disposed below the lifting member 71*b* to extend in the conveyance direction. Grooves 76*a*, into which the projections 71*e* are inserted, are formed at both ends of the part 76 in the scanning direction. As depicted in FIG. 4A, each groove 76*a* includes three parallel parts 76*b*, 76*c*, and 76*d* and two inclined parts 76*e*, 76*f* For easy understanding of the structure of the groove 76*a*, the length of the groove 76*a* in the conveyance direction in FIG. 4A is longer than that of FIG. 3.

The parallel part 76*b* is disposed at an upstream end of the part 76 in the conveyance direction and extends parallel to the conveyance direction. The parallel part 76*c* is disposed below the parallel part 76*b*, disposed downstream the parallel part 76*b* in the conveyance direction, and extends parallel to the conveyance direction. The parallel part 76*d* is disposed between the parallel parts 76*b*, 76*c* in the conveyance direction and an up-down direction and extends parallel to the conveyance direction. The inclined part 76*e* is disposed between the parallel parts 76*b* and 76*d* in the conveyance direction, extends while being inclined with respect to the conveyance direction, and connects the parallel parts 76*b* and 76*d*. The inclined part 76*f* is disposed between the parallel parts 76*c* and 76*d* in the conveyance direction, extends while being inclined with respect to the conveyance direction, and connects the parallel parts 76*c* and 76*d*. The inclined parts 76*e* and 76*f* have substantially the same inclined angle relative to the conveyance direction. The projection 71*e* slides on a lower surface 76*a*1 of the groove 76*a*.

In this embodiment, the inclined part 76*f* of the lower surface 76*a*1 of the groove 76*a* corresponds to a "first surface" of the present teaching; the parallel part 76*c* of the lower surface 76*a*1 of the groove 76*a* corresponds to a "second surface" of the present teaching; the parallel part 76*b* of the lower surface 76*a*1 of the groove 76*a* corresponds to a "third surface" of the present teaching; the inclining part 76*e* of the lower surface 76*a*1 of the groove 76*a* corresponds to a "fourth surface" of the present teaching; and the parallel part 76*d* of the lower surface 76*a*1 of the groove 76*a* corresponds to a "fifth surface" of the present teaching.

The part 77 is narrower than the part 76 in width and extends downstream in the conveyance direction from the center of the downstream end of the part 76 in the conveyance direction. An arm supporting part 77*a* is provided at the downstream end of the part 77 in the conveyance direction. The arm supporting part 77*a* extends in the scanning direction to swingably support a first end of the arm 74. A gear 77*c* extending in the conveyance direction is formed in a left side surface 77*b* of the part 77 in the scanning direction. The slider 72 includes an oil damper 78 engaging with the gear 77*c*. The oil dumper 78 prevents the slider 72 from sliding (moving suddenly) in the conveyance direction as will be described later. The slider 72 includes a sensor 79 detecting a position in the conveyance direction. The sensor 79 includes a light emitting element 79*a* and a light receiving element 79*b*. The light emitting element 79*a* is disposed on the left of the part 77 in the scanning direction, and the light receiving element 79*b* is disposed on the right of the part 77 in the scanning direction. The light emitting element 79*a* emits light to the light receiving element 79*b*. The light receiving element 79*b* receives the light emitted from the light emitting element 79*a*. Further, a light blocking part 77*d* (a "detection target" of the present teaching), which operates in connection with the sensor 79, is provided in the lower surface of the part 77. Whether or not the light blocking part 77*d* blocks the light emitted from the light emitting element 79*a* is switched when the slider 72 moves in the conveyance direction, as described later. The sensor 79 becomes an off state, in which no signal is outputted, when the light receiving element 79*b* receives the light emitted from the light emitting element 79*a*, and the sensor 79 becomes an on state, in which the signal is outputted, when the light receiving element 79*b* does not receive the light emitted from the light emitting element 79*a*. The position of the slider 72 and the switching of the sensor 79 between the on and off states will be described later in detail.

The crank gear 73 is disposed such that its axis direction is parallel to the scanning direction. An arm supporting part 73*a* supporting a second end of the arm 74 swingably is provided at a part, of a side surface of the crank gear 73, deviated from the center of the crank gear 73. The crank gear 73 engages with a bevel gear 129.

<Switch Valve>

Figure 6:
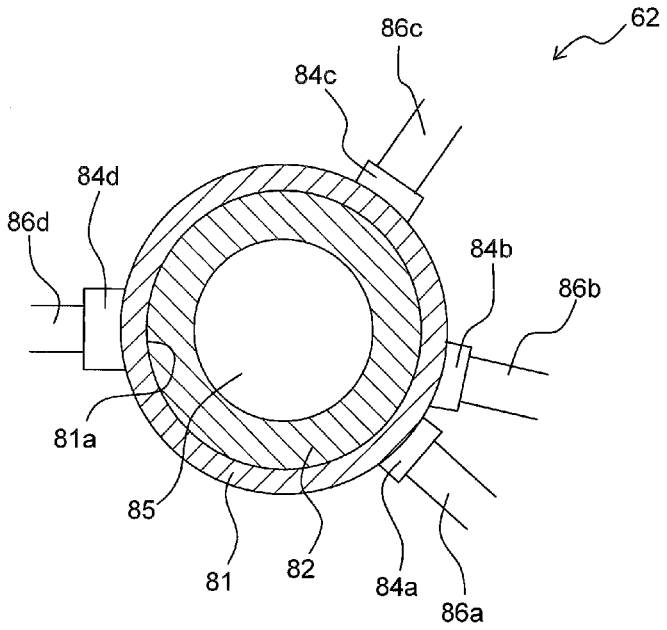
FIG. 6 is a cross-sectional view of the switch valve of FIG. 3 taken along the line VI-VI.

As depicted in FIGS. 3 and 6, the switch valve 62 includes an accommodating member 81 and a channel member 82. The accommodating member 81 is a cylindrical member of which lower end is closed. The accommodating member 81 includes two cap communicating ports 84*a*, 84*b*, an atmosphere communicating port 84*c*, and a pump communicating port 84*d*. The communicating ports 84*a* to 84*d* communicating with an internal space 81*a* protrude outward in a radial direction of the accommodating member 81 in mutually different directions. The cap communicating port 84*a* communicates with the nozzle cap 61*a* via a tube 86*a*. The cap communicating port 84*b* communicates with the nozzle cap 61*b* via a tube 86*b*. The atmosphere communicating port

84*c* communicates with the waste liquid tank 64 via a tube 86*c*. The pump communicating port 84*d* communicates with the suction pump 63 via a tube 86*d*.

The channel member 82, which is a cylindrical member made of a rubber material etc, is rotatably accommodated in the internal space 81 a of the accommodating member 81. The channel member 82 includes, for example, unillustrated grooves forming ink channels to make the communicating ports 84*a* to 84*d* communicate with each other. The channel member 82 is mounted on a valve cam 85. The valve cam 85 is connected to a valve drive gear group 134 including a valve drive gear 134*a*. Since the structure of the switch valve 62 is the same as that of conventional ones, the more detailed explanation thereof is omitted.

<Selective Gear Mechanism>

In this embodiment, power can be selectively transmitted from the ASF motor 102 to any one of the cap lifting mechanism 66 and the switch valve 62 via a selective gear mechanism 136. More specifically, as depicted in FIG. 3, FIG. 4B, and FIG. 4C, the selective gear mechanism 136 includes a selective drive gear 137 (a "first gear" of the present teaching), a bevel gear 138, and a planet gear mechanism 139. The selective drive gear 137, which is engageable with an ASF switch gear 122, is connected to the ASF motor 102 in a state of engaging with the ASF switch gear 122. The bevel gear 138 engages with the selective drive gear 137. The planet gear mechanism 139 includes a sun gear 139*a* and a planet gear 139*b*. The sun gear 139*a* engages with the bevel gear 138 and rotates together with the selective drive gear 137 and the bevel gear 138. The planet gear 139*b* engages with the sun gear 139*a*. The rotation of the sun gear 139*a* makes the planet gear 139*b* rotate about its own axis and an axis of the sun gear 139*a*.

When the ASF motor 102 rotates normally (clockwise) in a state that the selective drive gear 137 is connected to the ASF motor 102, the power of the ASF motor 102 is transmitted to the gears 137, 138, 139*a*, and 139*b*. This rotates the sun gear 139*a* in the counterclockwise direction in FIG. 4B and rotates the planet gear 139*b* about the axis of the sun gear 139*a* within a horizontal plane in the clockwise direction in FIG. 4B, thereby engaging the planet gear 139*b* with the bevel gear 129, as depicted in FIGS. 4B, 7A, 7B, 8A, and 8B. When the normal rotation of the ASF motor 102 is continued further in the above situation, the power of the ASF motor 102 is transmitted to the crank gear 73 via the bevel gear 129 to rotate the crank gear 73 in the counterclockwise direction in FIGS. 7A, 7B, 8A, and 8B. Interlocked with (in response to) the rotation of the crank gear 73, the slider 72 reciprocates in the conveyance direction (a "slide direction" of the present teaching).

When the slider 72 moves upstream in the conveyance direction, the projection 71*e* of the cap holding part 71 slides on the parallel part 76*b*, the inclined part 76*e*, the parallel part 76*d*, the inclined part 76*f*, and the parallel part 76*c*, of the lower surface 76*a*1 of the groove 76*a*, in that order. This lowers the cap holding part 71 and the cap unit 61. When the slider 72 moves downstream in the conveyance direction, the projection 71*e* of the cap holding part 71 slides on the parallel part 76*c*, the inclined part 76*f*, the parallel part 76*d*, the inclined part 76*e*, and the parallel part 76*b*, of the lower surface 76*a*1 of the groove 76*a*, in that order. This raises the cap holding part 71 and the cap unit 61. In both cases, the oil damper 78 rotates while being interlocked with (in response to) the movement of the slider 72. Accordingly, the cap lifting mechanism 66 converts the rotation of the crank gear 73 in one direction into the reciprocating movement of the slider 72 in the conveyance direction to make the projection 71*e* of the cap holding part 71 slide on the lower surface 76*a*1 of the groove 76*a* of the slider 72, thereby moving the cap holding part 71 and the cap unit 61 up and down.

Figure 7A:
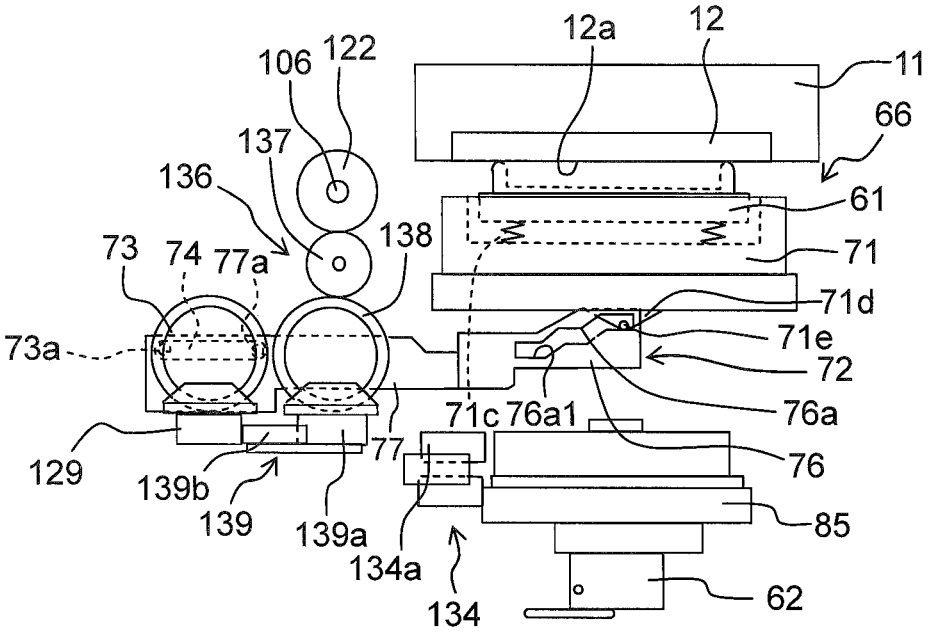
FIG. 7A is a diagram corresponding to FIG. 3 and depicting a state in which a nozzle cap is in a capping position.
Figure 7B:
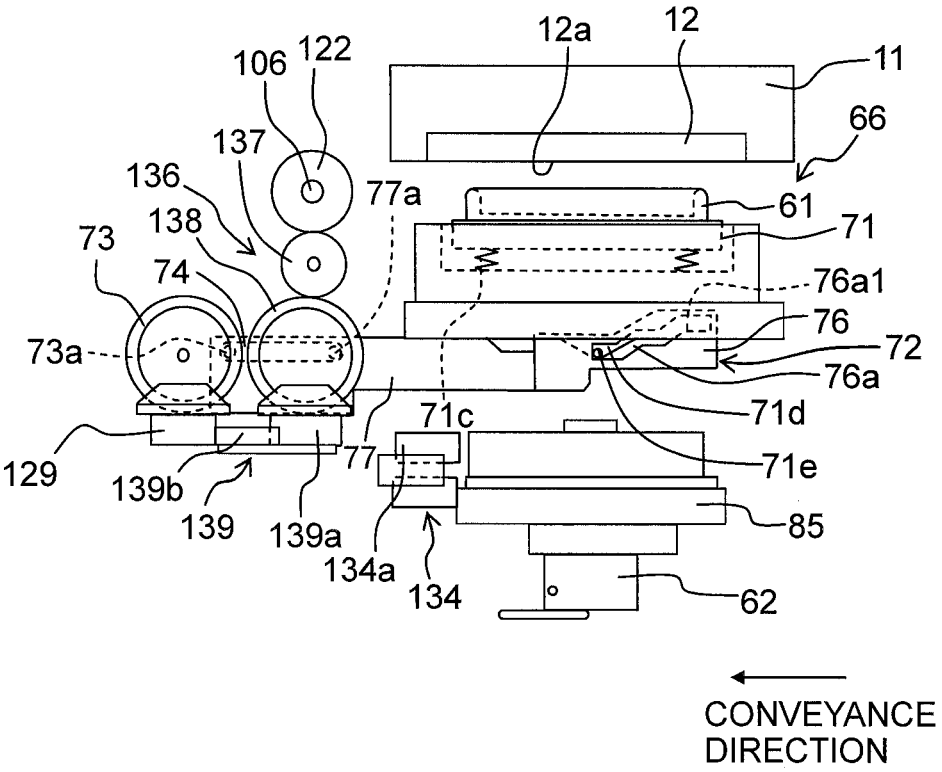
FIG. 7B is a diagram corresponding to FIG. 3 and depicting a state in which the nozzle cap is in an uncapping position.
Figure 8A:
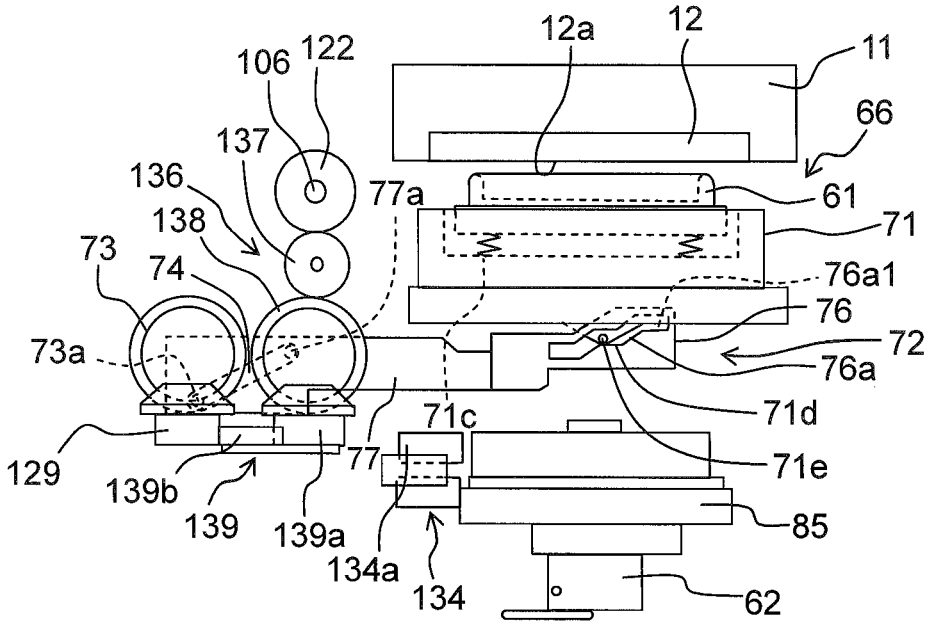
FIG. 8A is a diagram corresponding to FIG. 3 and depicting a state in which the nozzle cap is lowered to an intermediate position.
Figure 8B:
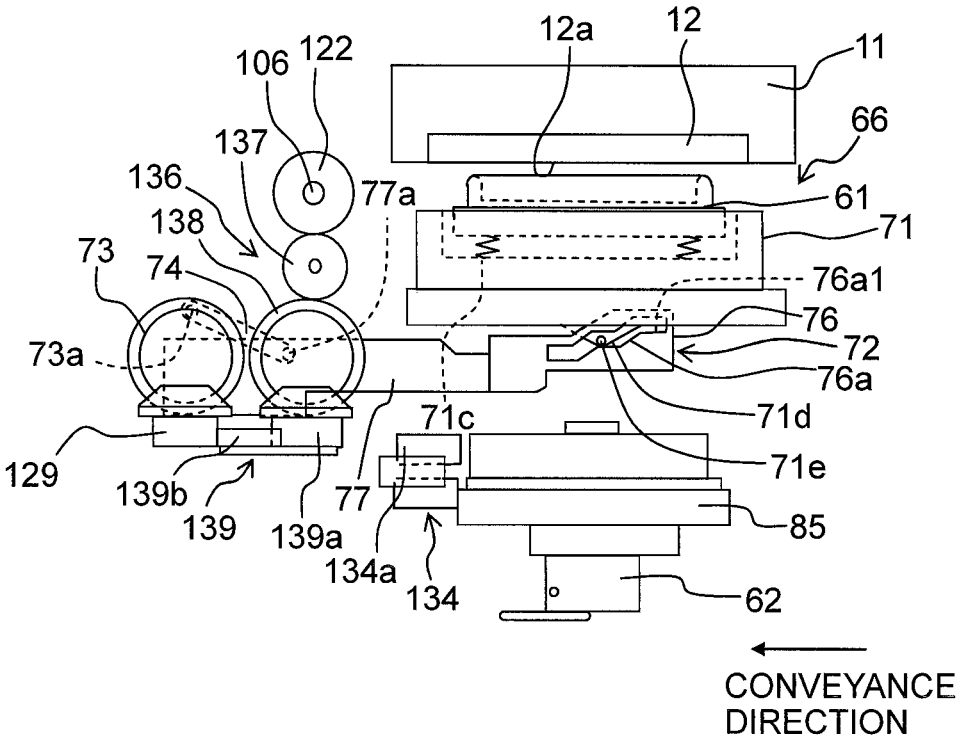
FIG. 8B is a diagram corresponding to FIG. 3 and depicting a state in which the nozzle cap is raised to the intermediate position.

As depicted in FIG. 7A, when the projection 71*e* is in the parallel part 76*b*, the cap unit 61 makes contact with the ink jetting surface 12*a* to cover nozzles 17 (in the following, this position of the cap unit 61 is to be referred to as a "capping position"). As depicted in FIG. 7B, when the projection 71*e* is in the parallel part 76*c*, the cap unit 61 is separated from the ink jetting surface 12*a* (in the following, this position of the cap unit 61 is to be referred to as an "uncapping position"). As depicted in FIGS. 8A and 8B, when the projection 71*e* is in the parallel part 76*d*, although the cap unit 61 is separated from the ink jetting surface 12*a*, the distance between the cap unit 61 and the ink jetting surface 12*a* is smaller than that of the case in which the projection 71*e* is in the parallel part 76*c* (in the following, this position of the cap unit 61 is to be referred to as an "intermediate position").

Figure 9A:
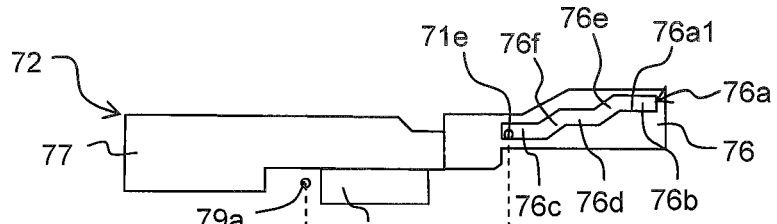
FIGS. 9A to 9G are diagrams each depicting a slider position and the change in a detection state of a sensor.
Figure 9B:
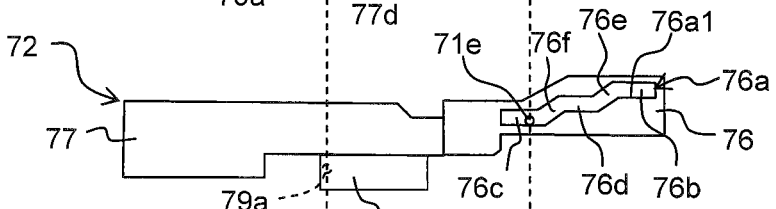
Figure 9C:
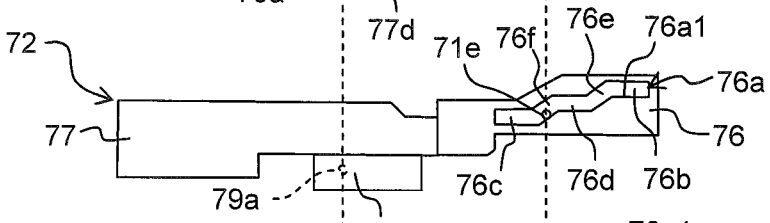
Figure 9D:
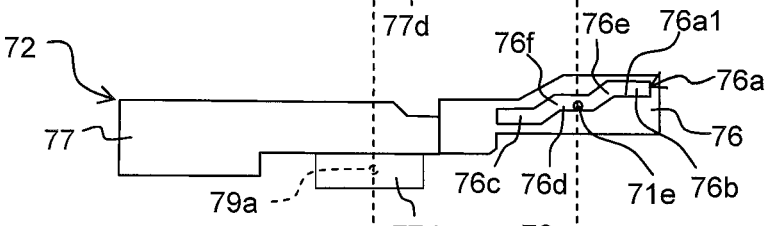
Figure 9E:
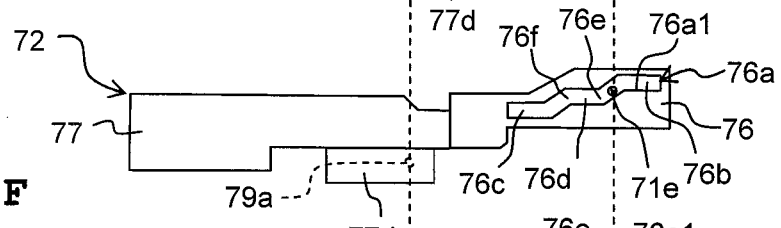
Figure 9F:
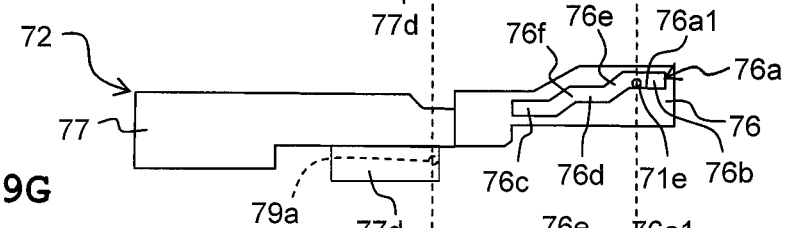
Figure 9G:
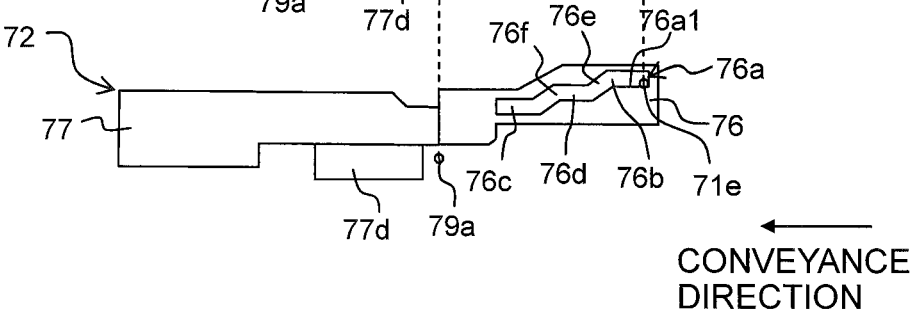

Here, an explanation will be made about the control of the ASF motor 102 for moving the cap unit 61 between the capping position and the uncapping position and the intermediate position. In this embodiment, the light blocking part 77*d* does not face the light emitting element 79*a* and the light receiving element 79*b*, when the projection 71*e* is positioned downstream (on the side opposite to the inclined part 760 of a predetermined point of the parallel part 76*c* (a point at which the projection 71*e* in FIG. 9B is positioned) in the conveyance direction as depicted in FIG. 9A, and when the projection 71*e* is positioned upstream of a predetermined point of the parallel part 76*b* (a point at which the projection 71*e* in FIG. 9F is positioned) in the conveyance direction as depicted in FIG. 9G. As depicted in FIGS. 9B to 9F, the light blocking part 77*d* faces the light emitting element 79*a* and the light receiving element 79*b*, when the projection 71*e* is positioned upstream (on the side of the inclined part 760 of the predetermined point of the parallel part 76*c* in the conveyance direction and downstream of the predetermined point of the parallel part 76*b* in the conveyance direction. For easy understanding, the lengths of the part 76 and the groove 76*a* of the slider 72 in the conveyance direction depicted in FIGS. 9A to 9G are longer than those depicted in FIG. 3A. In this embodiment, the position of the light blocking part 77*d* depicted in FIG. 9A corresponds to a "non-detection position" and the position of the light blocking part 77*d* depicted in FIG. 9B corresponds to a "detection positon" of the present teaching.

Figure 10:
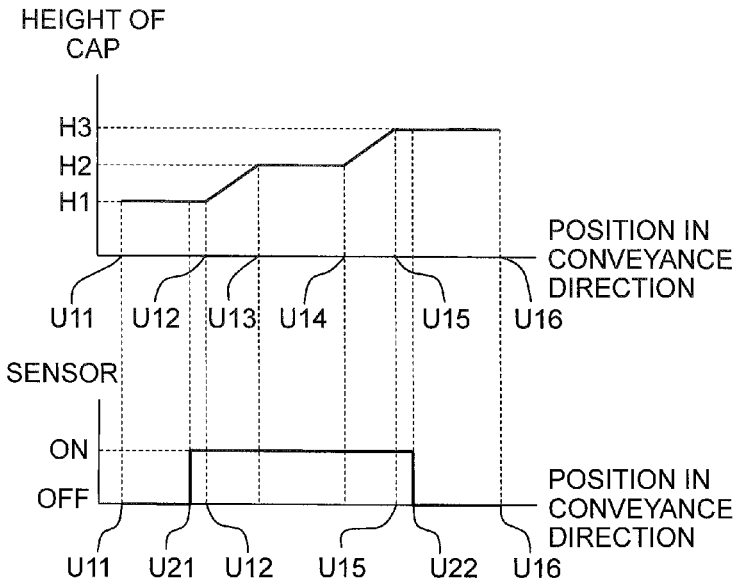
FIG. 10 depicts a relation between a slider position and a height of a cap unit and a relation between a slider position and on/off of the sensor.

In this embodiment, a horizontal axis in FIG. 10 shows a position of a part of the slider 72 (for example, the light blocking part 77*d*) in the conveyance direction and a vertical axis in FIG. 10 shows a height of the cap unit 61 from a reference surface or a signal from the sensor. As depicted in FIG. 10, the height of the cap unit 61 is H1, when the position of the part of the slider 72 is between a position U11 and a position U12 which is upstream of the position U11 in the conveyance direction; the height of the cap unit 61 is H2 which is higher than H1, when the position of the part of the slider 72 is between a position U13 which is upstream of the position U12 in the conveyance direction and a position U14 which is upstream of the position U13 in the conveyance direction; and the height of the cap unit 61 is H3 which is higher than H2 when the position of the part of the slider 72 is between a position U15 which is upstream of the position U14 in the conveyance direction and a position U16 which is upstream of the position U15 in the conveyance direction. When the position of the part of the slider 72 is between the position U12 and the position U13 or between the position U14 and the position U15, the height of the cap unit 61 is higher as the position of the part of the slider 72 is more upstream in the conveyance direction.

As depicted in FIG. 10, the sensor 79 is in the off state when the position of the part of the slider 72 is between the position U11 and the position U21 (an example of the non-detection section) or between the position U22 and the position U16. The length between the position U11 and the position U21 in the conveyance direction is shorter than the length of the parallel part 76*c* in the conveyance direction. The sensor 79 is in the on state when the position of the part of the slider 72 is between the position U21 and the position U22 (an example of the detection section). The position U21 is a position between the position U11 and the position U12, and the position U22 is a position between the position U15 and the position U16.

On the basis of the above, in this embodiment, the ASF motor 102 is rotated normally in a state that the cap unit 61 is in the capping position as depicted in FIG. 7A, thereby moving the slider 72 in the conveyance direction. When the sensor 79 switches from the off state to the on state due to the movement of the slider 72, the ASF motor 102 is rotated further by a predetermined amount to move the cap unit 61 from the capping position to the intermediate position as depicted in FIG. 8A. In this situation, since the parallel part 76*d* extends parallel to the conveyance direction, even if the rotation amount of the ASF motor 102 after the sensor 79 switches from the off state to the on state varies slightly, the projection 71*e* is positioned in the parallel part 76*d* and the cap unit 61 is in the intermediate position reliably.

In this embodiment, the ASF motor 102 is rotated further normally with the cap unit 61 being in the intermediate position. When the sensor 79 switches from the on state to the off state, the ASF motor 102 is rotated still further by a predetermined amount to move the cap unit 61 from the intermediate position to the uncapping position as depicted in FIG. 7B. Since the parallel part 76*c* extends parallel to the conveyance direction, even if the rotation amount of the ASF motor 102 after the sensor 79 switches from the on state to the off state varies slightly, the projection 71*e* is positioned in the parallel part 76*c* and the cap unit 61 is in the uncapping position reliably.

In this embodiment, the ASF motor 102 is rotated further normally with the cap unit 61 being in the uncapping position. When the sensor 79 switches from the off state to the on state, the ASF motor 102 is rotated still further by a predetermined amount to move the cap unit 61 from the uncapping position to the intermediate position as depicted in FIG. 8B. Since the parallel part 76*d* extends parallel to the conveyance direction, even if the rotation amount of the ASF motor 102 after the sensor 79 switches from the off state to the on state varies slightly, the projection 71*e* is positioned in the parallel part 76*d* and the cap unit 61 is in the intermediate position reliably.

In this embodiment, the ASF motor 102 is rotated further normally with the cap unit 61 being in the intermediate position. When the sensor 79 switches from the on state to the off state, the ASF motor 102 is rotated still further by a predetermined amount to move the cap unit 61 from the intermediate position to the capping position as depicted in FIG. 7A. Since the parallel part 76*b* extends parallel to the conveyance direction, even if the rotation amount of the ASF motor 102 after the sensor 79 switches from the on state to the off state varies slightly, the projection 71*e* is positioned in the parallel part 76*b* and the cap unit 61 is in the capping position reliably.

Figure 11:
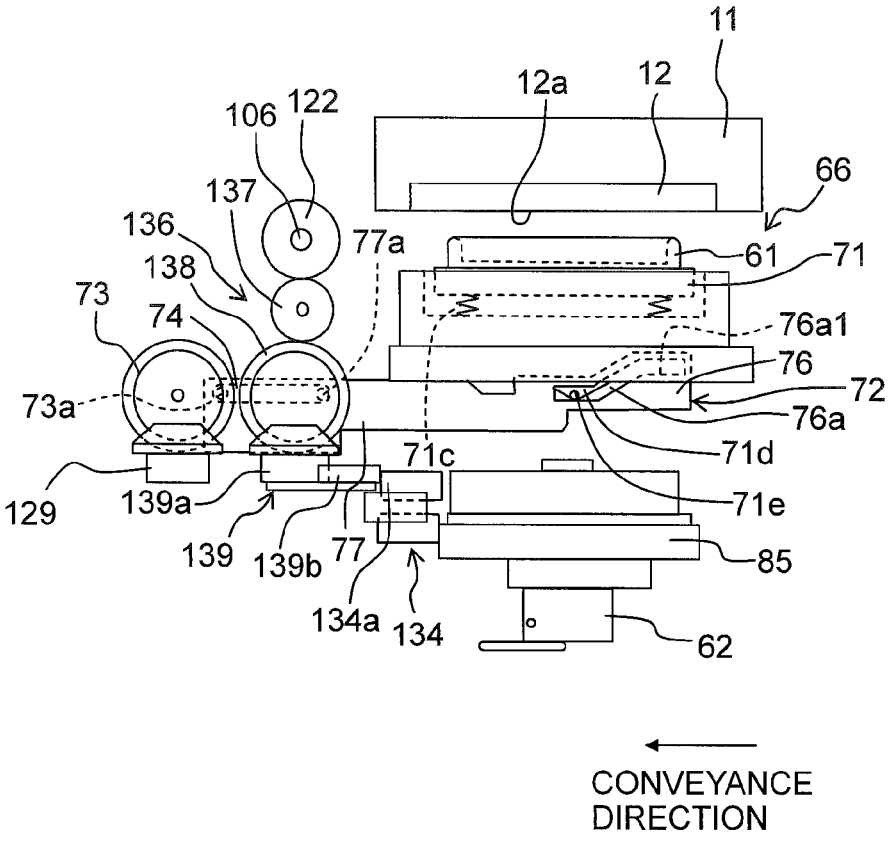
FIG. 11 is a diagram corresponding to FIG. 3 and depicting a state in which the switch valve is being driven.

When the ASF motor 102 is rotated counterclockwise with the selective drive gear 137 connected to the ASF motor 102, the power of the ASF motor 102 is transmitted to the gears 137, 138, 139*a*, and 139*b*. This rotates the sun gear 139*a* in the clockwise direction in FIG. 4C and rotates the planet gear 139*b* about the axis of the sun gear 139*a* within a horizontal plane in the counterclockwise direction in FIG. 4C, thereby engaging the planet gear 139*b* with the valve drive gear 134*a*, as depicted in FIG. 4C and FIG. 11. When the ASF motor 102 is further rotated counterclockwise with the planet gear 139*b* engaging with the valve drive gear 134*a*, the power of the ASF motor 102 is transmitted to the valve drive gear 134*a* to rotate respective gears constituting the valve drive gear group 134. This results in the rotations of the valve cam 85 and the channel member 82. The rotation of the channel member 82 switches the communication relation between the communicating ports 84*a* to 84*d* of the switch valve 62, such as the communication and non-communication between the cap communicating ports 84*a*, 84*b* and the pump communicating ports 84*d*.

Figure 12:
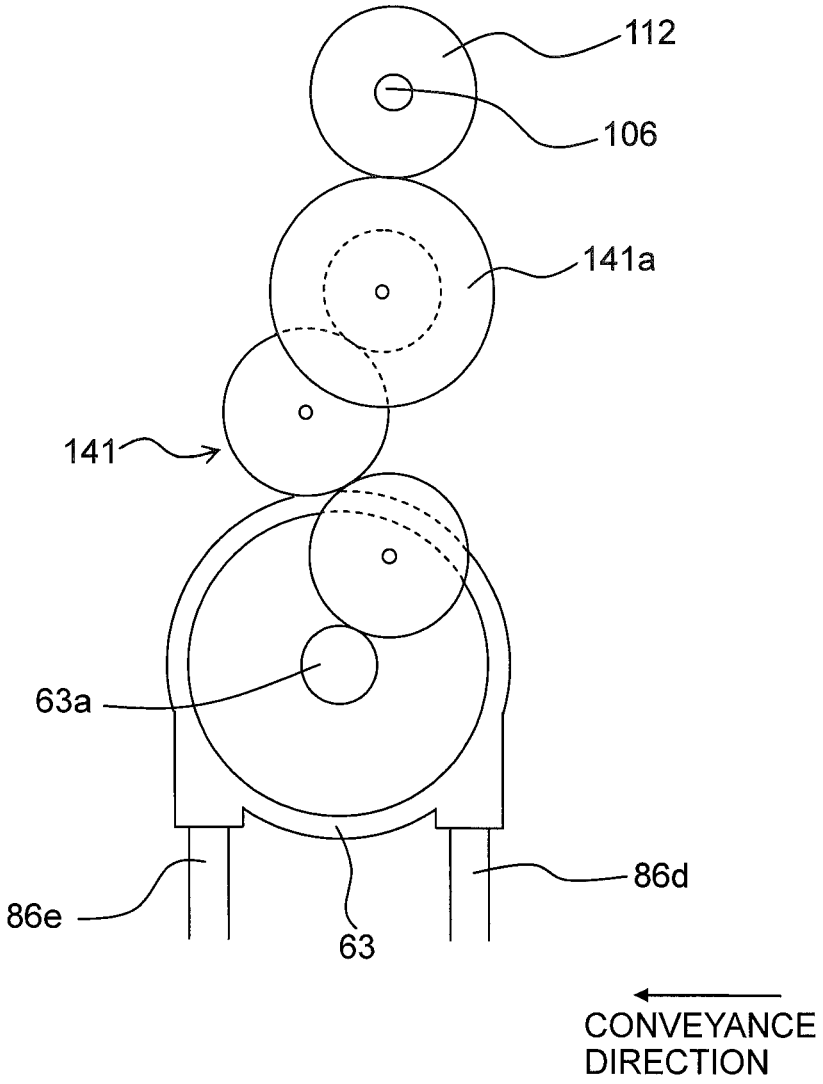
FIG. 12 depicts a suction pump and an arrangement of gears to be connected to the suction pump as viewed from the right in the scanning direction.

The suction pump 63 is a tube pump. As described above, the suction pump 63 communicates with the pump communicating port 84*d* of the switch valve 62 via the tube 86*d* and communicates with the waste liquid tank 64 via the tube 86*e* on the side opposite to the switch valve 62. As depicted in FIG. 12, the suction pump 63 includes a gear 63*a*. The gear 63*a*, which is connected to a pump drive gear group 141 including a pump drive gear 141*a*, is connectable to the PF motor 101 via the pump drive gear group 141 as will be described later. When the PF motor 101 is rotated normally with the suction pump 63 connected to the PF motor 101, the power of the PF motor 101 is transmitted to the suction pump 63 to make the suction pump 63 a non-communication state in which the tube 86*d* does not communicate with the tube 86*e*. When the PF motor 101 is rotated further normally, the suction pump 63 performs suction. When the PF motor 101 is rotated reversely, the power of the PF motor 101 is transmitted to the suction pump 63 to make the suction pump 63 a communication state in which the tube 86*d* communicates with the tube 86*e*. Since the tube pump which switches between the non-communication state and the communication state according to the rotation direction is well known, more detailed explanation thereof is omitted here.

The waste liquid tank 64 stores, for example, the ink discharged through the suction purge, etc., as described later. The space of the waste liquid tank 64 in which the ink is stored communicates with the atmosphere. Thus, the atmosphere communicating port 84*c*, which communicates with the waste liquid tank 64 via the tube 86*c*, communicates with the atmosphere. Further, when the suction pump 63 is in the communication state, the pump communicating port 84*d* communicates with the atmosphere via the tubes 86*d*, 86*e*, the suction pump 63, and the waste liquid tank 64.

<Switching of Motor Connection>

Subsequently, an explanation will be made about the switching of connection of each of the PF motor 101 and the ASF motor 102 with reference to FIGS. 13A to 13D, FIGS. 14A to 14D, FIG. 15, and FIG. 16. Noted that the solid lines connecting components in FIGS. 15, 16 mean that the components are always connected with each other, and the broken lines connecting components in FIGS. 15, 16 mean that there are a plurality of connection targets and any one of them is to be selectively connected.

As depicted in FIGS. 13A to 13D and FIG. 15, the PF motor 101 is connected to a drive shaft 105. The drive roller 13*a* is mounted on the drive shaft 105. Further, a PF input gear 111 is mounted on the drive shaft 105. Driving the PF motor 101 rotates the drive shaft 105, the drive roller 13*a*, and the PF input gear 111 integrally.

The PF input gear 111 engages with a PF switch gear 112. The PF switch gear 112 is rotatably supported by a shaft 106 extending in the scanning direction. The PF switch gear 112 is movable, while being interlocked with (in response to) the movement of the carriage 11 in the scanning direction, along the shaft 106 in the scanning direction. Thus, the PF switch gear 112 can selectively move to any of the positions depicted in FIGS. 13A to 13D. The PF switch gear 112 does not engage with the pump drive gear 141*a* in the positions depicted in FIGS. 13A, 13B, and 13C, and the PF switch gear 112 engages with the pump drive gear 141*a* in the position depicted in FIG. 13D. The PF switch gear 112 engages with the PF input gear 111 in all of the positions depicted in FIGS. 13A, 13B, 13C, and 13D.

As depicted in FIGS. 14A to 14D, and FIG. 16, the ASF motor 102 is connected to an ASF input gear group 121. The ASF input gear group 121 includes an ASF input gear 121*a*, and the ASF input gear 121*a* engages with the ASF switch gear 122. The ASF switch gear 122 is rotatably supported by the shaft 106. The ASF switch gear 122 is mounted on the shaft 106 such that the positional relation between the ASF switch gear 122 and the PF switch gear 112 in the scanning direction is always kept. Thus, when the PF switch gear 112 moves while being interlocked with (in response to) the movement of the carriage 11 in the scanning direction, the ASF switch gear 122 also moves in the scanning direction.

In this embodiment, the ASF switch gear 122 can selectively move to any of the positions depicted in FIGS. 13A to 13D during its movement in the scanning direction. The ASF switch gear 122 in the position depicted in FIG. 13A engages with the lower feed gear 131. The ASF switch gear 122 in the position depicted in FIG. 13B engages with the upper feed gear 132. The ASF switch gear 122 in the positions depicted in FIG. 13C and FIG. 13D engages with the selective drive gear 137.

In this embodiment, the carriage 11 moving the switch gears 112 and 122 in the scanning direction corresponds to a "gear movement device" of the present teaching.

<Controller>

Figure 17:
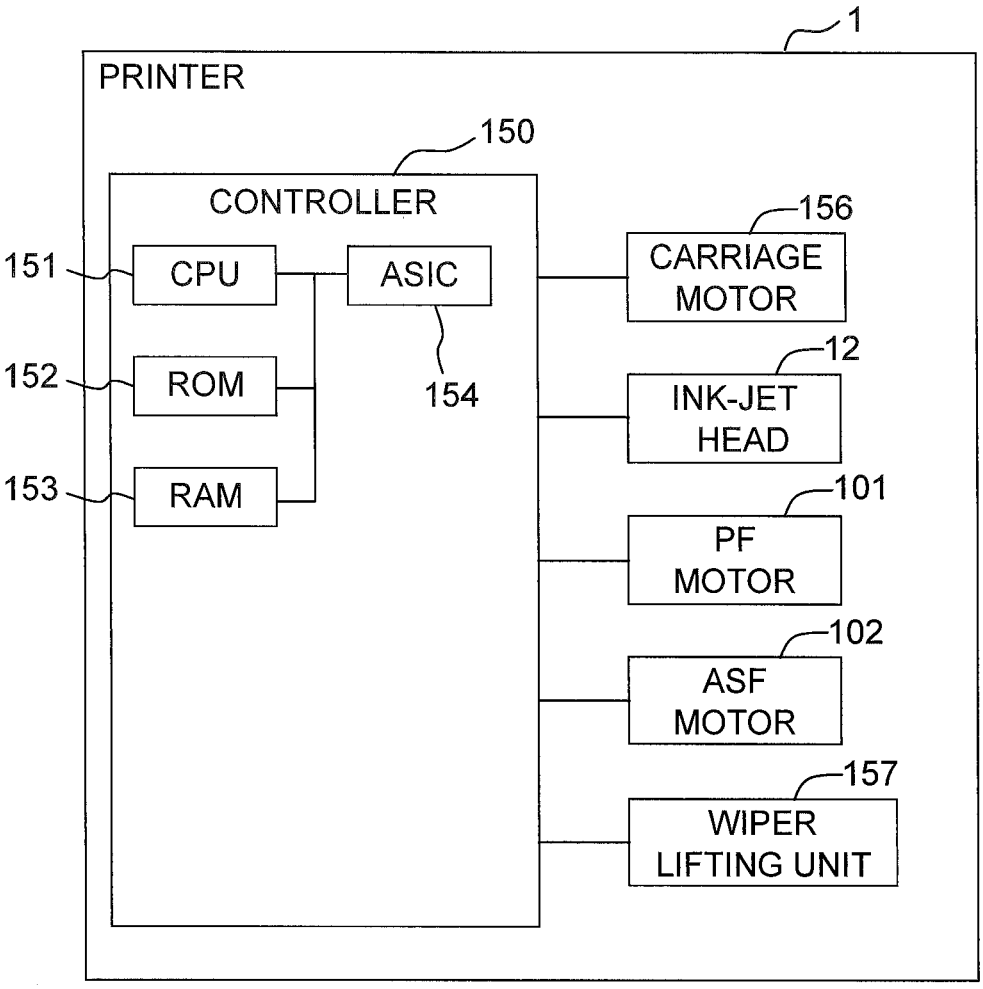
FIG. 17 is a block diagram depicting an electrical configuration of the printer.

Subsequently, an explanation will be made about a controller 150 which controls the operation of the printer 1. As depicted in FIG. 17, the controller 150 includes a Central Processing unit (CPU) 151, a Read Only Memory (ROM) 152, a Random Access Memory (RAM) 153, an Application Specific Integrated Circuit (ASIC) 154, and the like. They work cooperatively to control the operation of the carriage motor 156, the ink-jet head 12, the PF motor 101, the ASF motor 102, the wiper lifting unit 157, and the like.

The controller 150 may include the single CPU 151, as depicted in FIG. 17, and the CPU 151 may perform processing collectively. Alternatively, the controller 150 may include a plurality of CPUs 151 and the CPUs 151 may perform processing in a shared manner. The controller 150 may include the single ASIC 154, as depicted in FIG. 17, and the ASIC 154 may perform processing collectively. Alternatively, the controller 150 may include a plurality of ASICs 154 and the ASICs 154 may perform processing in a shared manner.

<Print Operation>

Figure 18:
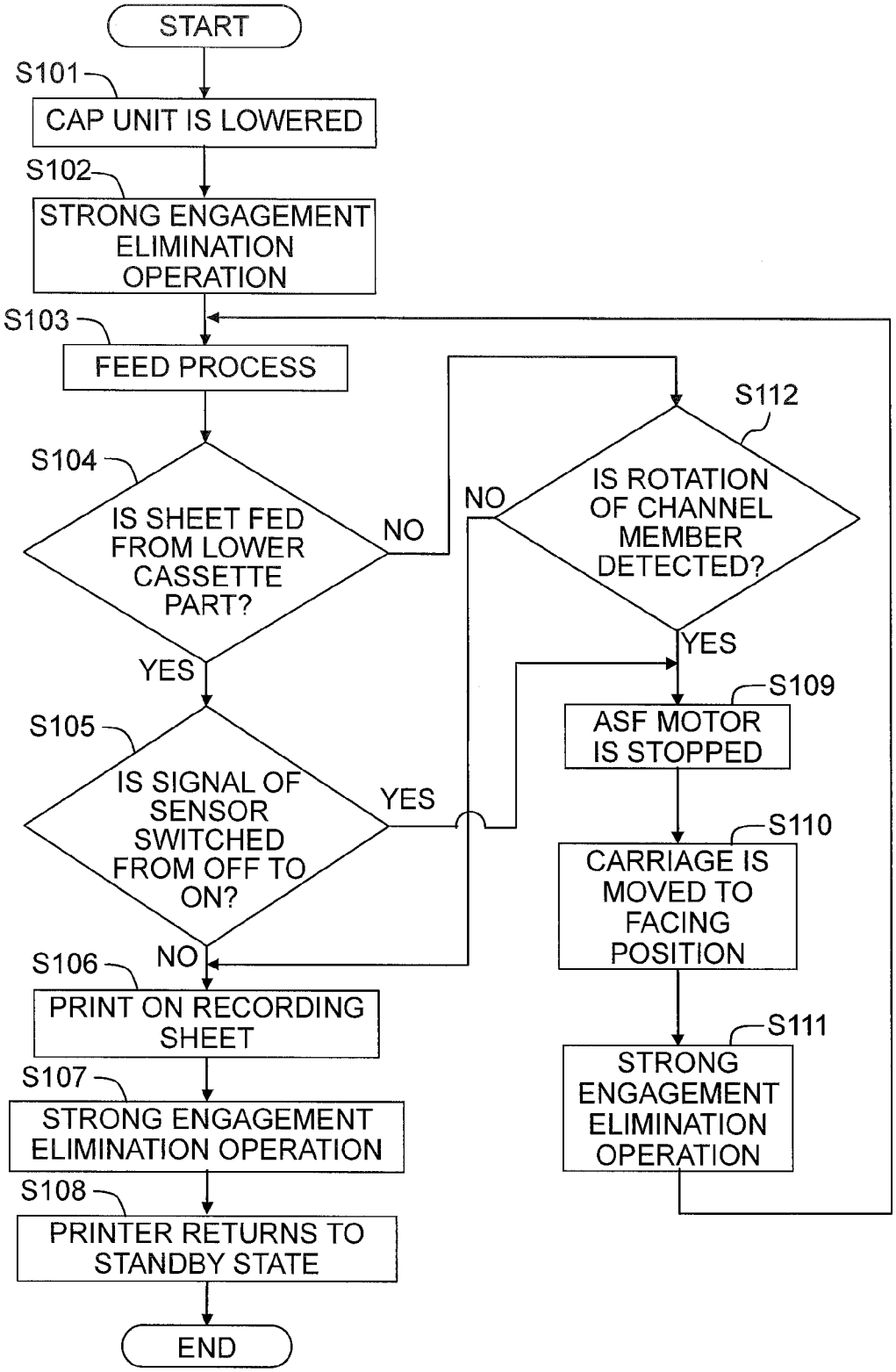
FIG. 18 is a flowchart of the print performed by the printer.
Figure 19A:
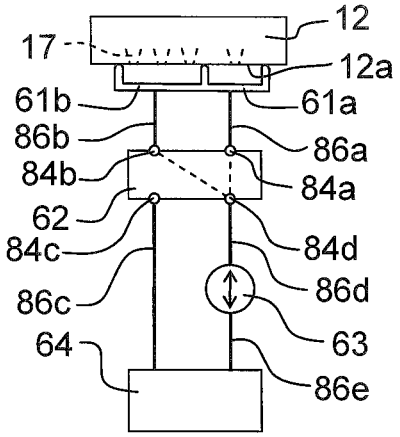
FIG. 19A to 19F are diagrams each depicting a communication relation between the nozzle cap and the switch valve and the suction pump, FIG. 19A depicting a standby state, FIG. 19B depicting a state in which valve cleaning is being performed, FIG. 19C depicting a state in which the suction purge for black ink is being performed, FIG. 19D depicting a state in which the suction purge for color inks is being performed, FIG. 19E depicting a state in which the idle suction for black ink is being performed, FIG. 19F depicting a state in which the idle suction for color inks is being performed.

Subsequently, an explanation will be made about a method of performing print with the printer 1. The printer 1 perform the print in accordance with the procedure indicated in the flowchart of FIG. 18. When the printer 1 is in a standby state in which no print and no maintenance which will be described later are performed, the cap unit 61 makes contact with the ink jetting surface 12*a* to prevent the ink in nozzles 17 from being dried. In the standby state, as depicted in FIG. 19A, the cap communicating ports 84*a* and 84*b* of the switch valve 62 communicate with the pomp communicating port 84*d* of the switch valve 62. In the standby state, the suction pump 63 is in the communication state. Thus, the nozzle caps 61*a* and 61*b* covering the nozzles 17 communicate with the atmosphere via the suction pump 63 in the standby state. In the standby state, the PF switch gear 112 and the ASF switch gear 122 are in the positions depicted in FIG. 13D. In FIG. 19A, the two-headed arrow indicates the communication state of the suction pump 63.

To make the printer 1 perform print, at first, the ASF motor 102 is rotated normally to lower the cap unit 61 to the uncapping position (S101). Next, in order to eliminate the strong engagement between the ASF switch gear 122 and the selective drive gear 137, the ASF motor 102 is driven to perform strong engagement elimination operation in which the ASF switch gear 122 repeatedly rotates in both directions by a minute angle (S102). Next, a feed process is performed to supply the recording sheet P to the print unit 2 from any of the feed cassettes 21 and 31 (S103). In particular, the carriage 11 is moved first to move the PF switch gear 112 and ASF switch gear 122 to any of the positions depicted in FIG. 13A and 13B. When the switch gears 112 and 122 move in the position depicted in FIG. 13A, the ASF motor 102 is rotated normally to feed the recording sheet P from the lower cassette feed part 3. When the switch gears 112 and 122 move in the position depicted in FIG. 13B, the ASF motor 102 is rotated reversely to feed the recording sheet P from the upper cassette feed part 4.

When the recording sheet P is fed from the lower cassette part 3 (S104: Yes), and if the sensor 79 does not switch from the off state to the on state (S105: No), print is performed on the recording sheet P (S106). More specifically, continuing the driving of the ASF motor 102 continues the feeding of the recording sheet P from the lower cassette feed part 3. Then, rotating the PF motor 101 normally makes the conveyance rollers 13 and 14 convey each supplied recording sheet P in the conveyance direction. The carriage motor 156 is driven to move the carriage 11 reciprocatively in the scanning direction and the ink-jet head 12 is driven to jet the ink from nozzles 17, thereby performing the print on the recording sheet P. After completion of the print, the strong engagement elimination operation is performed (S107) and the printer 1 returns to the standby state (S108). In particular, the carriage motor 156 is driven to move the carriage 11 to the facing position, and the ASF motor 102 is rotated normally with the carriage 11 being in the facing position to move the cap unit 61 to the capping position, thereby making the cap unit 61 contact with the ink jetting surface 12*a*.

When the sensor 79 switches from the off state to the on state (S105: Yes), the ASF motor 102 is stopped (S109). Then, the carriage motor 156 is driven to move the carriage 11 to the facing position (S110).

After that, the ASF motor 102 is driven to perform the strong engagement elimination operation (S111). In the strong engagement elimination operation in S111, the ASF switch gear 122 repeatedly rotates a larger number of times than the strong engagement elimination operation in S102. After completion of the strong engagement elimination operation in S111, the process returns to S103.

When the recording sheet P is fed from the upper cassette part 4 (S104: No), and if the rotation of the channel member 82 is not detected (S112: No), the process proceeds to S106. When the rotation of the channel member 82 is detected (S112: Yes), the process proceeds to S109. In this step, the rotation angle of the channel member 82 is required to be controlled with relatively high precision. Thus, the switch valve 62 includes an unillustrated sensor detecting the rotation angle of the channel member 82. In S111, for example, the rotation of the channel member 82 is detected based on a signal from this sensor.

<Maintenance>

Subsequently, an explanation will be made about the maintenance using the maintenance unit 7. The printer 1 performs the maintenance in accordance with the flowchart of FIG. 20.

Figure 20:
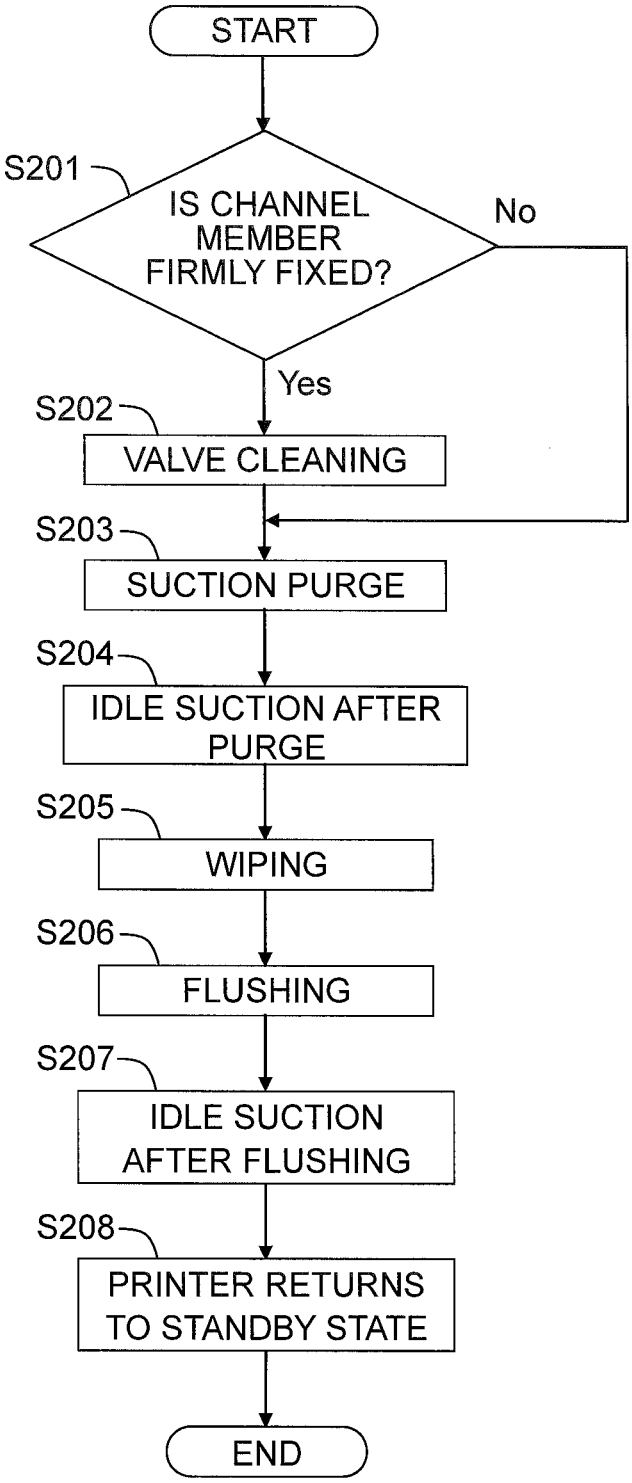
FIG. 20 is a flowchart of maintenance.

In the maintenance, as depicted in FIG. 20, the controller 150 first determines whether the channel member 82 is fixed so firmly to the accommodating member 81 that the channel member 82 can not rotate (S201). When the channel member 82 is not fixed firmly to the accommodating member 81 (S201: No), the process proceeds to S203. When the channel member 82 is fixed firmly to the accommodating member 81 (S201: Yes), valve cleaning is performed (S202) and the process proceeds to S203. In S201, for example, the determination is made as follows. Namely, when the ASF motor 102 is rotated reversely for a prescribed time period with the printer 1 being in the standby state, the channel member 82 may not rotate. In that case, a current flowing through the ASF motor 102 will exceed a predetermined threshold value, which makes it possible for the controller 150 to determine that the channel member 82 is fixed firmly to the accommodating member 81.

Figure 19B:
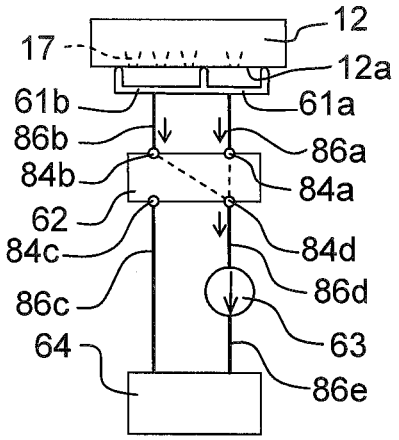

In the valve cleaning, as depicted in FIG. 19B, rotating the PF motor 101 normally with the printer 1 being in the standby state allows the suction pump 63 to perform suction. The ink in the ink-jet head 12 is discharged from nozzles 17 through the suction, flowing into the switch valve 62. The ink solidified in the switch valve 62 dissolves by absorbing the moisture or water of the ink flowing into the switch valve 62, thereby eliminating the firm fixation of the channel member 82 to the accommodating member 81. Further, the ASF motor 102 is rotated reversely during the suction with the suction pump 63 to rotate the channel member 82. This rotation allows the ink flowing into the switch valve 62 to spread over respective parts in the switch valve 62 uniformly, thereby making it possible to eliminate the firm fixation of the channel member 82 to the accommodating member 81 efficiently. In FIG. 19B, down arrows indicate a state in which the suction pump 63 in the non-communication state performs the suction. The same is true on FIGS. 19C to 19F.

When suction purge or idle suction which will be described later is performed, the ink flows into the switch valve 62. If the ink flowing into the switch valve 62 is left for a long time, it may solidify to cause the channel member 82 to be firmly fixed to the accommodating member 81. The firm fixation of the channel member 82 to the accommodating member 81 may fail to rotate the channel member 82 during the suction purge or the idle suction. In this embodiment, the valve cleaning eliminates the firm fixation of the channel member 82 to the accommodating member 81.

In S203, the suction purge is performed. More specifically, in S203, both of the suction purge for black ink in which viscous black ink in the ink-jet head 12 is discharged and the suction purge for color inks in which viscous color inks in the ink-jet head 12 are discharged are performed successively.

Figure 13A:
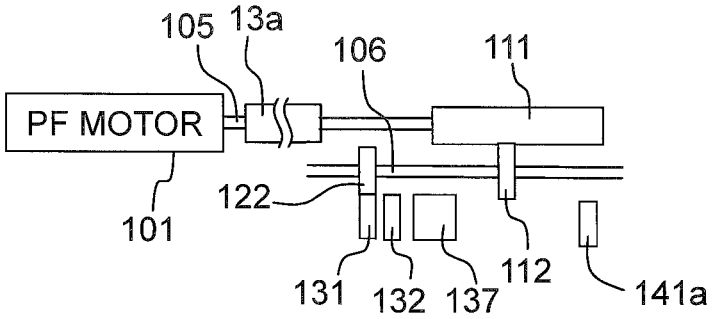
FIGS. 13A to 13D are diagrams each illustrating a connection relation between a PF motor and a feed roller and a PF input gear and a PF switch gear, FIG. 13A depicting a state in which an ASF switch gear engages with an upper feed gear, FIG. 13B depicting a state in which the ASF switch gear engages with a lower feed gear, FIG. 13C depicting a state in which the PF switch gear fails to engage with a pump drive gear and the ASF switch gear engages with a selective drive gear, FIG. 13D depicting a state in which the PF switch gear engages with the pump drive gear and the ASF switch gear engages with the selective drive gear.
Figure 13B:
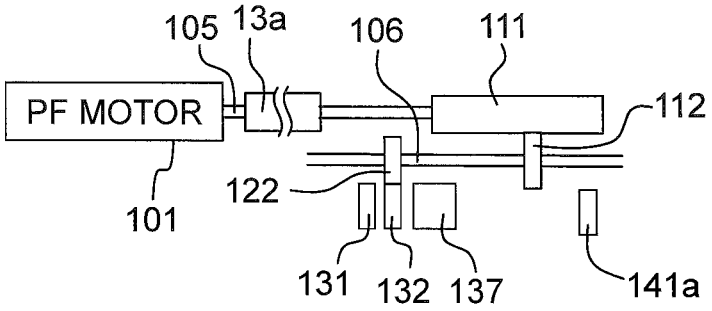
Figure 13C:
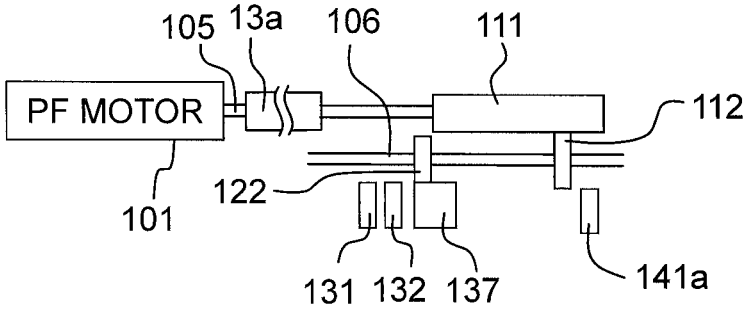
Figure 13D:
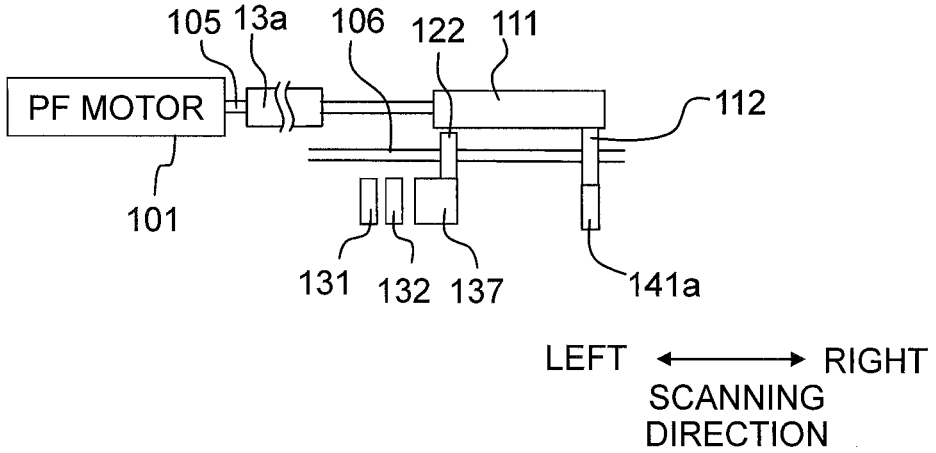
Figure 14A:
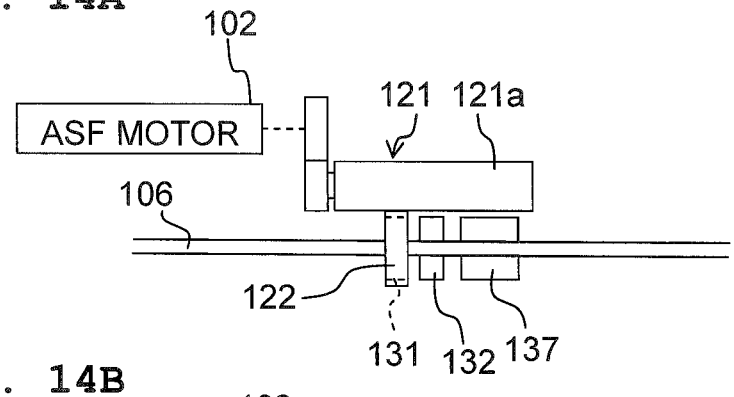
FIGS. 14A to 14D are diagrams each illustrating a connection relation between an ASF motor and an ASF input gear and the ASF switch gear as well as the switching of connection by the ASF switch gear, FIG. 14A depicting a state corresponding to FIG. 13A, FIG. 14B depicting a state corresponding to FIG. 13B, FIG. 14C depicting a state corresponding to FIG. 13C, FIG. 14D depicting a state corresponding to FIG. 13D.
Figure 14B:
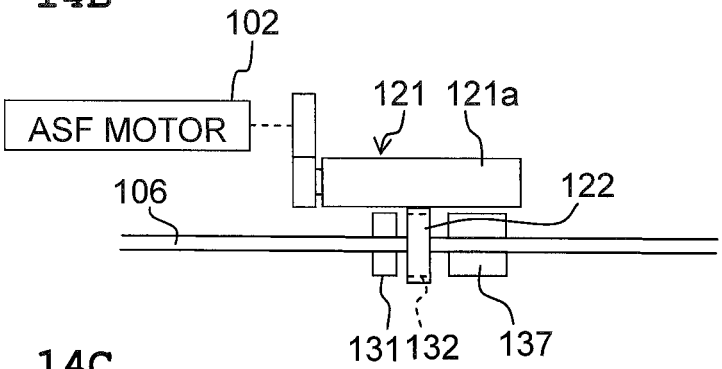
Figure 14C:
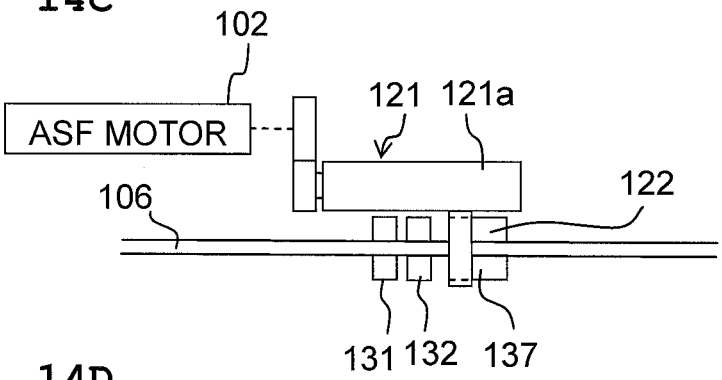
Figure 14D:
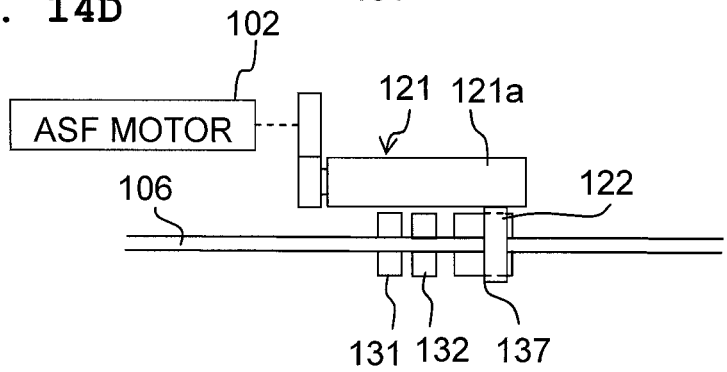
Figure 15:
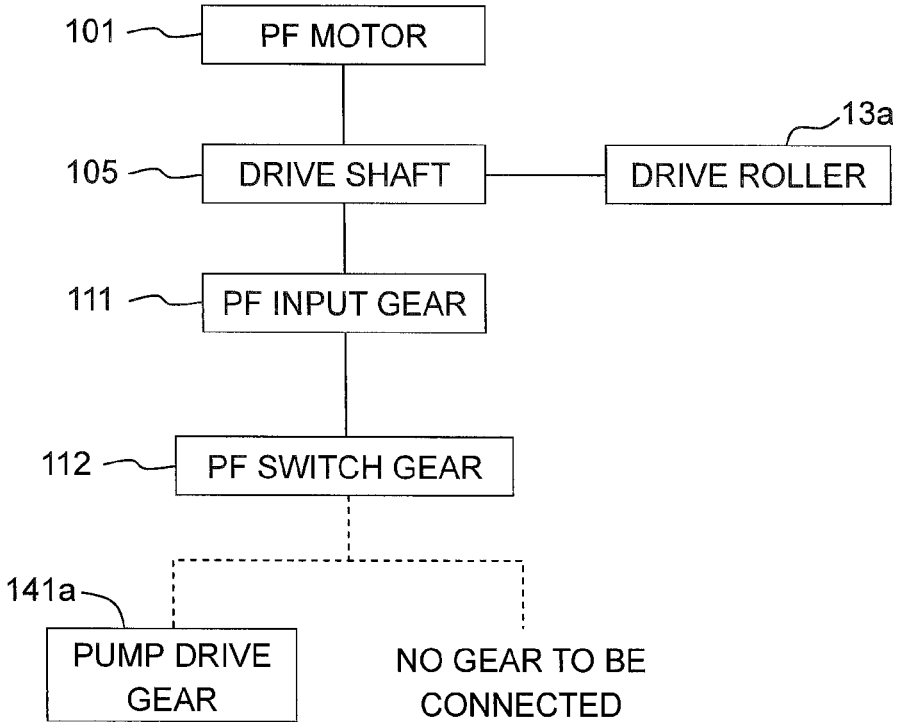
FIG. 15 is a block diagram illustrating a connection relation for the PF motor.
Figure 16:
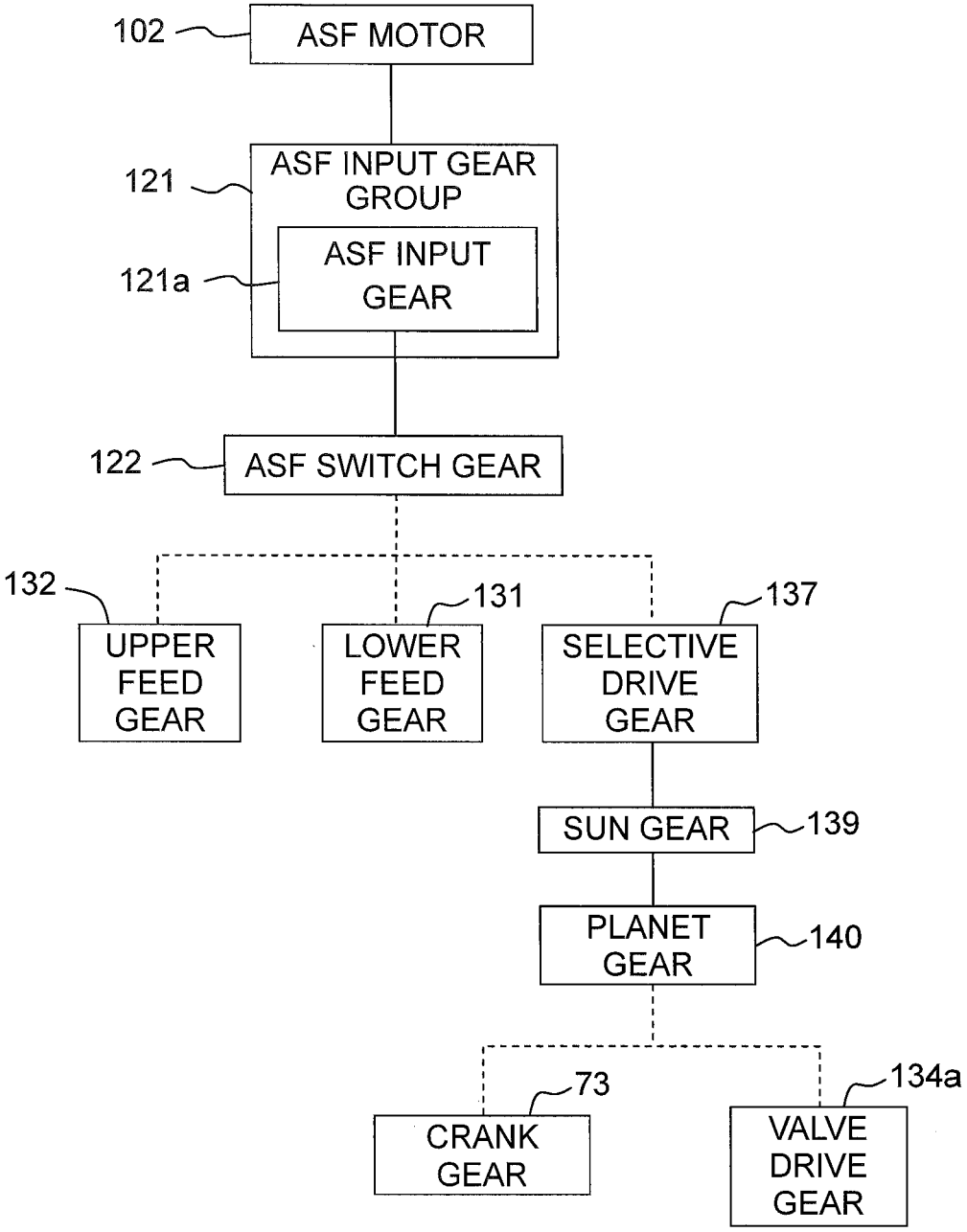
FIG. 16 is a block diagram illustrating a connection relation for the ASF motor.
Figure 19C:
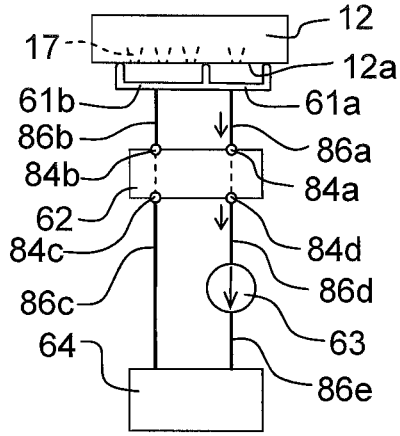

In the suction purge for black ink, the ASF motor 102 is rotated reversely to rotate the channel member 82 in a state that the cap unit 61 is in the capping position and the switch gears 112, 122 are in the positions depicted in FIG. 13D. The rotation of the channel member 82 allows the cap communicating port 84*a* to communicate with the pump communicating port 84*d* and allows the cap communicating port 84*b* to communicate with the atmosphere communicating port 84*c*, as depicted in FIG. 19C. In this situation, the PF motor 101 is rotated normally to make the suction pump 63 perform the suction. Accordingly, the viscous black ink in the ink-jet head 12 is discharged from the nozzles 17 forming the rightmost nozzle row 18. The reason why the cap communicating port 84*b* is allowed to communicate with the atmosphere communicating port 84*c* is that this prevents the increase in pressure in the nozzle cap 61*b* which would be otherwise caused when the deformation of the cap unit 61 during suction reduces the volume of the space in the nozzle cap 61*b*.

Figure 19D:
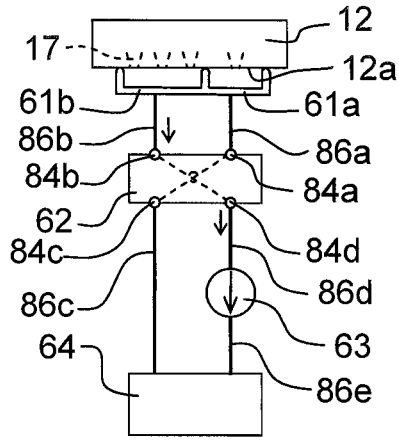

In the suction purge for color inks, the ASF motor 102 is rotated reversely to rotate the channel member 82 in the state that the cap unit 61 is in the capping position and the switch gears 112, 122 are in the positions depicted in FIG. 13D. The rotation of the channel member 82 allows the cap communicating port 84*b* to communicate with the pump communicating port 84*d* and allows the cap communicating port 84*a* to communicate with the atmosphere communicating port 84*c*, as depicted in FIG. 19D. In this situation, the PF motor 101 is rotated normally to make the suction pump 63 perform the suction. Accordingly, the viscous color inks in the ink-jet head 12 are discharged from the nozzles 17 forming the three nozzle rows 18 on the left of the rightmost nozzle row 18. The reason why the cap communicating port 84*a* is allowed to communicate with the atmosphere communicating port 84*c* is that this prevents the increase in pressure in the nozzle cap 61*a* which would be otherwise caused when the deformation of the cap unit 61 during suction reduces the volume of the space in the nozzle cap 61*a*.

Subsequently, the idle suction, in which the ink accumulating in the cap unit 61 is discharged, is performed (S204). More specifically, in S204, both of the idle suction for black ink in which the black ink accumulated in the nozzle cap 61*a* by the suction purge for black ink is discharged and the idle suction for color inks in which the color inks accumulated in the nozzle cap 61*b* by the suction purge for color inks are discharged are performed successively.

Figure 19E:
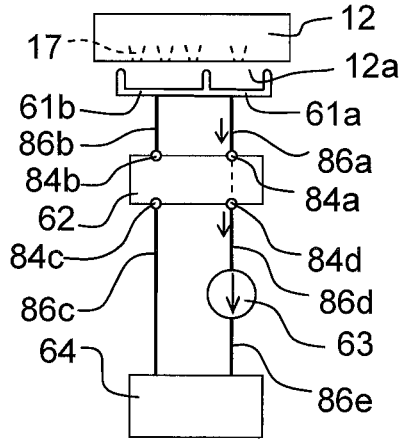

In the idle suction for black ink, the ASF motor 102 is rotated normally to rotate the crank gear 73 in a state that the switch gears 112, 122 are in the positions depicted in FIG. 13D. The rotation of the crank gear 73 lowers the cap unit 61 to the intermediate position, as depicted in FIG. 8A. Subsequently, the ASF motor 102 is rotated reversely to rotate the channel member 82. The rotation of the channel member 82 allows the cap communicating port 84*a* to communicate with the pump communicating port 84*d*, as depicted in FIG. 19E. In this situation, the PF motor 101 is rotated normally to make the suction pump 63 perform the suction. Accordingly, the black ink accumulated in the nozzle cap 61*a* is discharged.

Figure 19F:
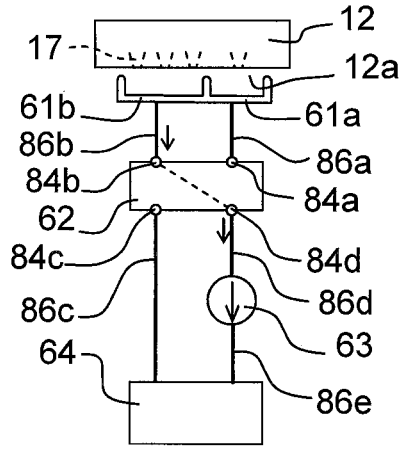

In the idle suction for color inks, the ASF motor 102 is rotated reversely to rotate the channel member 82 in a state that the cap unit 61 is in the intermediate position as depicted in FIG. 8A. The rotation of the channel member 82 allows the cap communicating port 84*b* to communicate with the pump communicating port 84*d*, as depicted in FIG. 19F. In this situation, the PF motor 101 is rotated normally to make the suction pump 63 perform the suction. Accordingly, the color inks accumulated in the nozzle cap 61*b* are discharged.

In some cases, except this embodiment, the ink (bridge) between the cap unit 61 and the ink jetting surface 12*a* may be broken when the cap unit 61 is lowered to the uncapping position to perform the idle suction to separate the cap unit 61 from the ink jetting surface 12*a*. This may cause the ink to be scattered around the cap unit 61. In this embodiment, the cap unit 61 is lowered to the intermediate position to perform the idle suction, and the height of the intermediate position of the cap unit 61 is designed such that the ink bridge is not broken when the cap unit 61 is lowered to the intermediate position. Thus, in this embodiment, it is possible to prevent the ink from being scattered around the cap unit 61 which would be otherwise caused by the destruction of the ink bridge before the idle suction.

Subsequently, wiping is performed to wipe the ink adhering to the ink jetting surface 12*a* by using the wiper 59 (S205). To perform the wiping, the ASF motor 102 is rotated normally to rotate the crank gear 73. The rotation of the crank gear 73 lowers the cap unit 61 to the uncapping position, as depicted in FIG. 7B. Further, the wiper lifting unit 157 is driven to move the wiper 59 upward, and the carriage motor 156 is driven to move the carriage 11 in the scanning direction. Accordingly, the ink adhering to the ink jetting surface 12*a* is wiped using the wiper 59. If the cap unit 61 is in the intermediate position during the wiping, the ink jetting surface 12*a* may make contact with the cap unit 61 during the movement of the carriage 11 in the scanning direction, because the distance between the cap unit 61 and the ink jetting surface 12*a* in the state that the cap unit 61 is in the intermediate position is smaller than that of the case in which the cap unit 61 is in the uncapping position. In this embodiment, in order to prevent the ink jetting surface 12*a* from making contact with the cap unit 61, the cap unit 61 is lowered from the intermediate position to the uncapping position before the start of the wiping operation.

Subsequently, flushing is performed to discharge the ink flowing into the nozzles 17 through the wiping, from nozzles 17 (S206). To perform the flushing, the carriage motor 156 is driven to return the carriage 11 to the facing position. Then, the ASF motor 102 is rotated normally to rotate the crank gear 73. The rotation of the crank gear 73 raises the cap unit 61 up to the intermediate position, as depicted in FIG. 8B. In this situation, the ink is discharged from the nozzles 17 of the ink-jet head 12 to the cap unit 61.

In some cases, except for this embodiment, the flashing may be performed in a state that the cap unit 61 is in the uncapping position. In that case, the ink jetted from the nozzles 17 through the flushing may spatter on the cap unit 61 to fly out of the cap unit 61. In this embodiment, during the flushing, the cap unit 61 is in the intermediate position which is closer to the ink jetting surface 12*a* than the uncapping position. This prevents the ink jetted from nozzles 17 through the flushing from spattering on the cap unit 61 to fly out of the cap unit 61.

Subsequently, the idle suction similar to S204 is performed to discharge the ink accumulated in the cap unit 61 through the flushing (S207). After completion of the idle suction in S207, the ASF motor 102 is rotated normally to move the cap unit 61 to the capping position as depicted in FIG. 7A, and the printer 1 is returned to the standby state (S208). The maintenance is completed, accordingly.

In the above embodiment, when the recording sheet P is fed from the lower cassette feed part 3, the carriage 11 is moved to switch the ASF switch gear 122 from the state in which it engages with the selective drive gear 137 to the state in which it engages with the lower feed gear 131. Then, the ASF motor 102 is rotated normally. Here, if the ASF switch gear 122 strongly engages with the selective drive gear 137, the movement of the carriage 11 fails to perform the switching, and the state in which the ASF switch gear 122 engages with the selective drive gear 137 is maintained. If the ASF motor 102 is rotated normally in the state in which the ASF switch gear 122 engages with the selective drive gear 137, the cap lifting mechanism 66 is driven to raise the cap unit 61. If the cap unit 61 reaches the capping position, the carriage 11 may hit the cap unit 61 when returning to the facing position. The impact caused by the collision between the carriage 11 and the cap unit 61 may break the meniscuses of ink in nozzles 17.

To solve the problem, in this embodiment, the carriage 11 is moved to switch the ASF switch gear 122 from the state in which it engages with the selective drive gear 137 to the state in which it engages with the lower feed gear 131. In a case that the sensor 79 is switched from the off state to the on state when the ASF motor 102 is rotated normally, the ASF motor 102 is stopped. This prevents the cap unit 61 from reaching the capping position.

In this embodiment, the sensor 79 switches from the off state to the on state when the projection 71*e* moves from a position which is downstream of the predetermined point of the parallel part 76*c* in the conveyance direction (the state depicted in FIG. 9A) to a position which is upstream of the predetermined point of the parallel part 76*c* in the conveyance direction (the state depicted in FIG. 9B). This stops the ASF motor 102 in a state that the projection 71*e* is in the parallel part 76*c* and the cap unit 61 is in the uncapping position. Namely, the ASF motor 102 is stopped before the upward movement of the cap unit 61 from the uncapping position to the intermediate position is started.

In this embodiment, the carriage 11 is moved to the facing position after the ASF motor 102 is stopped. Since the ASF motor 102 is stopped before the cap unit 61 reaches the capping position, the carriage 11 is prevented from hitting the cap unit 61 during the movement of the carriage 11.

In this embodiment, the ASF motor 102 is rotated normally in a state that the cap unit 61 is in the uncapping position. When the sensor 79 switches from the off state to the on state, the ASF motor 102 is rotated further normally by a predetermined amount to move the cap unit 61 to the intermediate position. Namely, in this embodiment, the driving of the cap lifting mechanism 66 is detected based on the signal of the sensor 79 and the cap unit 61 is moved from the uncapping position to the intermediate position with reference to the position at which the sensor 79 switches from the off state to the on state (the position at which the signal is inputted from the sensor 79).

In this embodiment, when the recording sheet P is fed from the lower cassette part 3, the ASF switch gear 122 engages with the lower feed gear 131. When the recording sheet P is fed from the upper cassette part 4, the ASF switch gear 122 engages with the upper feed gear 132. Here, as described above, the ASF switch gear 122 may fail to engage with a target gear in switching. Thus, in this embodiment, the rotation direction of the ASF motor 102 when the recording sheet P is fed from the lower cassette feed part 3 is made to be opposite to that when the recording sheet P is fed from the upper cassette feed part 4. Accordingly, when the ASF switch gear 122 fails to engage with a target gear in switching (S103), it is possible to prevent the recording sheet P from being fed from a cassette feed part which is different from the proper cassette feed part.

To feed the recording sheet P from the lower cassette feed part 3, the carriage 11 is required to move so that the ASF switch gear 122 is switched to engage with the lower feed gear 131. If the switching fails, the ASF switch gear 122 may engage with the upper feed gear 132. When the ASF motor 102 is rotated normally with the ASF switch gear 122 erroneously engaging with the upper feed gear 132, for example, an unillustrated roller may rotate, the unillustrated roller returning the recording paper P to the upstream side in the conveyance direction in the case of both-side print. In general, during the supply of the recording sheet P, no recording sheet P is in a position where the roller returning the recording sheet P to the upstream side in the conveyance direction is disposed, thus causing no serious problem.

To feed the recording sheet P from the upper cassette feed part 4, the carriage 11 is required to move so that the ASF switch gear 122 is switched to engage with the upper feed gear 132. If the switching fails, the ASF switch gear 122 may engage with the lower feed gear 131. When the ASF motor 102 is rotated reversely with the ASF switch gear 122 erroneously engaging with the lower feed gear 131, all that can occur is the rotation of the feed roller 22 in a direction opposite to the direction for paper feeding, namely, the reverse rotation of the ASF motor 102 drives no device or unit.

In this embodiment, the rotation direction of the ASF motor 102 when the recording sheet P is fed from the lower cassette feed part 3 is opposite to that when the recording sheet P is fed from the upper cassette feed part 4. Thus, the rotation direction of the ASF motor 102 when the cap lifting mechanism 66 is driven is coincident with the rotation direction of the ASF motor 102 when the recording sheet P is fed from the lower cassette feed part 3 or the rotation direction of the ASF motor 102 when the recording sheet P is fed from the upper cassette feed part 4 (in this embodiment, the rotation direction of the ASF motor 102 when the cap lifting mechanism 66 is driven is coincident with the rotation direction of the ASF motor 102 when the recording sheet P is fed from the lower cassette feed part 3). Thus, it is noteworthy that the ASF motor 102 is stopped when the normal rotation of the ASF motor 102 switches the sensor 79 from the off state to the on state after the movement of the carriage 11 switching the ASF switch gear 122 from the state in which it engages with the selective drive gear 137 to the state in which it engages with the lower feed gear 131.

In this embodiment, the switch gears 112 and 122 move in the scanning direction while being interlocked with (in response to) the movement of the carriage 11. Thus, in order to switch gears to be engaged with the switch gears 112 and 122, the carriage 11 is required to move in a state that the cap unit 61 is in the uncapping position. When the cap unit 61 moves upward from the uncapping position to the capping position with the carriage 11 being away from the facing position, the carriage 11 may hit the cap unit 61 when returning to the facing position. Thus, it is noteworthy that the ASF motor 102 is stopped when the normal rotation of the ASF motor 102 switches the sensor 79 from the off state to the on state after the movement of the carriage 11 switching the ASF switch gear 122 from the state in which it engages with the selective drive gear 137 to the state in which it engages with the lower feed gear 131.

Next, an explanation will be made about modified embodiments in which various modifications are added to the above embodiment.

In the above embodiment, the printer 1 includes two feed parts, the lower cassette feed part 3 and the upper cassette feed part 4, and two feed gears, the feed gears 131 and 132 corresponding to the feed parts 3 and 4 respectively and connectable to the ASF switch gear 122. The present teaching, however, is not limited thereto. The printer 1 may include two or less or four or more of feed parts and two or less or four or more of feed gears which correspond to the feed parts respectively and are connectable to the ASF switch gear 122. In this configuration, the rotation direction of the ASF motor 102 when the recording sheet P is fed from any of the feed parts may be the same as the rotation direction of the ASF motor 102 when the cap unit 61 is moved upward and downward.

In the above embodiment, rotating the ASF motor 102 normally with the ASF switch gear 122 engaging with the selective drive gear 137 moves the cap unit 61 upward and downward, and rotating the ASF motor 102 reversely with the ASF switch gear 122 engaging with the selective drive gear 137 rotates the channel member 82. The present teaching, however, is not limited thereto.

For example, the following configuration is also allowable. Namely, rotating the ASF motor 102 normally with the ASF switch gear 122 engaging with the selective drive gear 137 rotates the channel member 82, and rotating the ASF motor 102 reversely with the ASF switch gear 122 engaging with the selective drive gear 137 moves the cap unit 61 upward and downward. In this configuration, unlike the above embodiment, when the recording sheet P is fed from the upper cassette feed part 4 (S104: No), the process proceeds to S105, and when the recording sheet P is fed from the lower cassette feed part 3 (S104: Yes), the process proceeds to S111. In that configuration, the direction in which the ASF motor 102 rotates reversely corresponds to the "predetermined direction" of the present teaching; the direction in which the ASF motor 102 rotates normally corresponds to the "direction opposite to the predetermined direction" of the present teaching; the feed roller 32 corresponds to the "first sheet supply device" of the present teaching; and the feed roller 22 corresponds to the "second sheet supply device" of the present teaching.

When the ASF motor 102 is rotated, in a direction opposite to the direction in which the cap unit 61 is moved upward and downward, with the ASF switch gear 122 engaging with the selective drive gear 137, each component or part of the printer 1 may operate differently from the above embodiment.

Figure 21A:
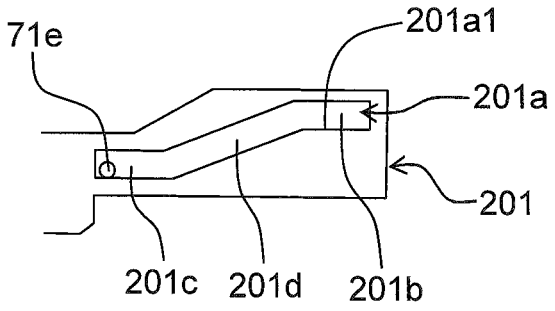
FIG. 21A is a diagram of a first modified embodiment corresponding to FIG. 4A.

In the above embodiment, the groove 76*a* of the slider 72 includes three parallel parts 76*b*, 76*c*, 76*d* and two inclined parts 76*e*, 76*f* The present teaching, however, is not limited thereto. In a first modified embodiment, as depicted in FIG. 21A, a groove 201*a* of a slider 201 includes two parallel parts 201*b*, 201*c* and an inclined part 201*d*. The parallel part 201*b* is formed similarly to the parallel part 76*b* and the cap unit 61 is in the capping position in a state that the projection 71*e* is in the parallel part 201*b*. The parallel part 201*c* is formed similarly to the parallel part 76*c* and the cap unit 61 is in the uncapping position in a state that the projection 71*e* is in the parallel part 201*c*. The inclined part 201*d*, which extends in the conveyance direction while being inclined, connects the parallel parts 201*b* and 201*c*. In the first modified embodiment, the inclined part 201*d* of a lower surface 201*a*1 of the groove 201*a* corresponds to the "first surface" of the present teaching and the parallel part 201*c* corresponds to the "second surface" of the present teaching.

In the first modified embodiment, when the cap lifting mechanism 66 is driven in a state that the cap unit 61 is in the uncapping position, the projection 71*e* moves from a position which is downstream of a predetermined point of the parallel part 201*c* in the conveyance direction to a position which is upstream of the predetermined point of the parallel part 201*c* in the conveyance direction. This switches the sensor 79 from the off state to the on state. Thus, by stopping the ASF motor 102 at the timing at which the sensor 79 switches from the off state to the on state, the ASF motor 102 is stopped before the upward movement of the cap unit 61 is started.

In the above embodiment, the cap lifting mechanism 66 starts the upward movement of the cap unit 61 when the ASF motor 102 is rotated by the predetermined amount or more with the cap unit 61 being in the uncapping position. The present teaching, however, is not limited thereto.

Figure 21B:
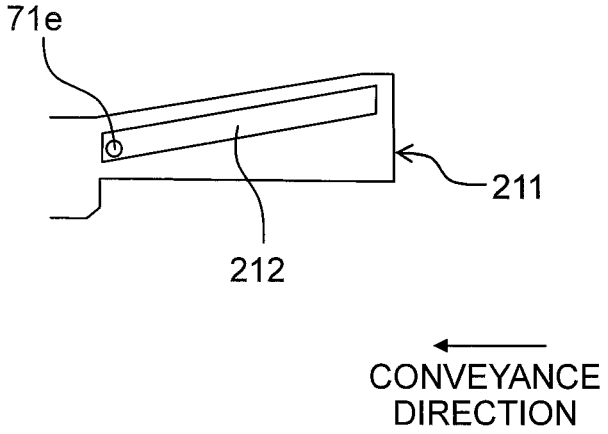
FIG. 21B is a diagram of a second modified embodiment corresponding to FIG. 4A.

In a second modified embodiment, as depicted in FIG. 21B, a groove 212 of a slider 211 has no parallel part parallel to the conveyance direction. The groove 212 extends in the conveyance direction while being inclined as a whole. In that case, when the ASF motor 102 is rotated normally to move the slider 72 in the conveyance direction with the cap unit 61 being in an uncapping state, the upward movement of the cap unit 61 is started immediately. When the projection 71*e* reaches a predetermined part of the groove 212 which is inclined to the conveyance direction, the sensor 79 switches from the off state to the on state. Thus, by stopping the ASF motor 102 at the timing at which the sensor 79 switches from the off state to the on state, the driving of the cap lifting mechanism 66 is stopped in a state that the cap unit 61 is positioned between the uncapping position and the capping position, that is, before reaching the capping position.

In the above embodiment, the slider 72 is connected to the crank gear 73 via the arm 74 so that the rotation of the crank gear 73 converts into the movement of the slider 72 in the conveyance direction. The present teaching, however, is not limited thereto. Instead of the crank gear 73, any other device may be provided to convert the rotation of the ASF motor 102 into the reciprocate movement of the slider 72 in the conveyance direction.

In the above embodiment, the cap lifting mechanism 66 moves the cap holding part 71 and the cap unit 61 up and down by sliding the projection 71*e* of the cap holding part 71 on the lower surface 76*a*1 of the groove 76*a* of the slider 72 reciprocating in the conveyance direction. The present teaching, however, is not limited thereto. The cap lifting mechanism 66 may have another configuration moving the cap unit 61 up and down by the normal rotation of the ASF motor 102.

Figure 22A:
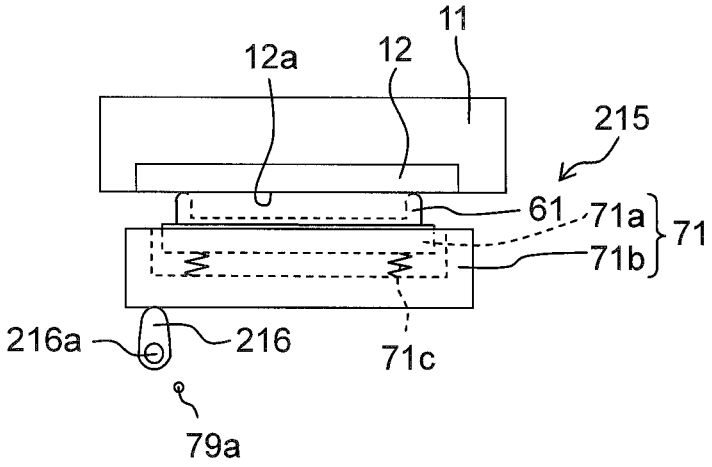
FIGS. 22A to 22C are diagrams each illustrating a cap lifting mechanism of a third modified embodiment, FIG. 22A depicting a state in which the cap unit is in the capping position, FIG. 22B depicting a state in which the cap unit is in the uncapping position, FIG. 22C depicting a state in which the sensor is switched from the off state to the on state.
Figure 22B:
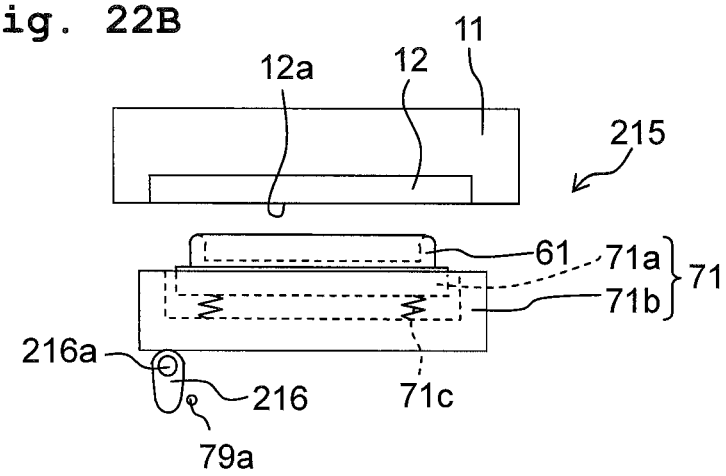
Figure 22C:
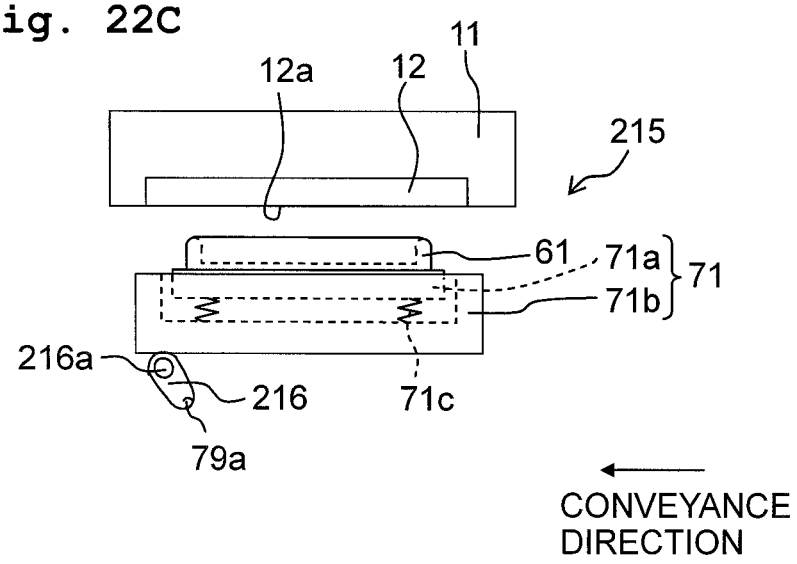

For example, in a third modified embodiment, as depicted in FIGS. 22A to 22C, a cap lifting mechanism 215 includes the cap holding part 71 similar to that of the above embodiment and an eccentric cam 216. The eccentric cam 216, which is disposed on the lower side of the lifting member 71*b*, supports the lifting member 71*b* from below. When the ASF motor 102 is rotated normally with the ASF switch gear 122 being connected to the selective drive gear 137, the eccentric cam 216 is connected to the selective drive gear 137 via an unillustrated gear or the like. The power from the ASF motor 102 rotates the eccentric cam 216 counterclockwise about a shaft 216*a*. This rotation moves the cap holding part 71 and the cap unit 61 between the capping position, as depicted in FIG. 22A, in which the cap unit 61 makes contact with the ink jetting surface 12*a* and the uncapping position, as depicted in FIG. 22B, in which the cap unit 61 is separated from the ink jetting surface 12*a*.

In the third modified embodiment, the sensor 79 similar to that of the above embodiment is provided (FIG. 22A to 22C only depicts the light emitting element 79*a*). As depicted in FIG. 22B, the light emitted from the light emitting element 79*a* is not blocked by the eccentric cam 216 in a state that the cap unit 61 is in the uncapping position. As depicted in FIG. 22C, the light emitted from the light emitting element 79*a* is blocked by the eccentric cam 216 (the sensor 79 switches from the off state to the on state) when the eccentric cam 216 in the state of FIG. 22B rotates counterclockwise by a predetermined angle.

Thus, also in the third modified embodiment, the cap unit 61 is prevented from moving to the capping position by stopping the ASF motor 102, when the normal rotation of the ASF motor 102 switches the sensor 79 from the off state to the on state after the movement of the carriage 11 switching the ASF switch gear 122 from the state in which it engages with the selective drive gear 137 to the state in which it engages with the lower feed gear 131.

In the above embodiment, the transmission destination (the feed roller 22 or the feed roller 32) of power from the ASF motor 102 is switched by switching the engagement between the ASF switch gear 122 engaging with the ASF input gear 121*a* and the feed gear 131 or the feed gear 132. The present teaching, however, is not limited thereto. For example, a single feed gear (the "second gear" of the present teaching) may be provided instead of the feed gears 131 and 132, and the planet gear mechanism may be provided between the single feed gear and the feed rollers 32, 33. In this configuration, rotating the ASF motor 102 normally may connect the single feed gear and the feed roller 32 via the planet gear mechanism and rotating the ASF motor 102 reversely may connect the single feed gear and the feed roller 33 via the planet gear mechanism.

In the above embodiment, the switch gears 112 and 122 move in the scanning direction while being interlocked with the movement of the carriage 11. The present teaching, however, is not limited thereto. The switch gears 112 and 122 may be moved in the scanning direction by another drive source. In that case, the PF switch gear 112 and the ASF switch gear 122 may not move integrally, and they may be moved by different drive sources individually.

In the configuration in which the switch gears 112 and 122 are moved by another drive source, the ink-jet head 12 is not limited to a so-called serial head which is carried on the carriage and jets the ink from nozzles while moving together with the carriage in the scanning direction.

Figure 23:
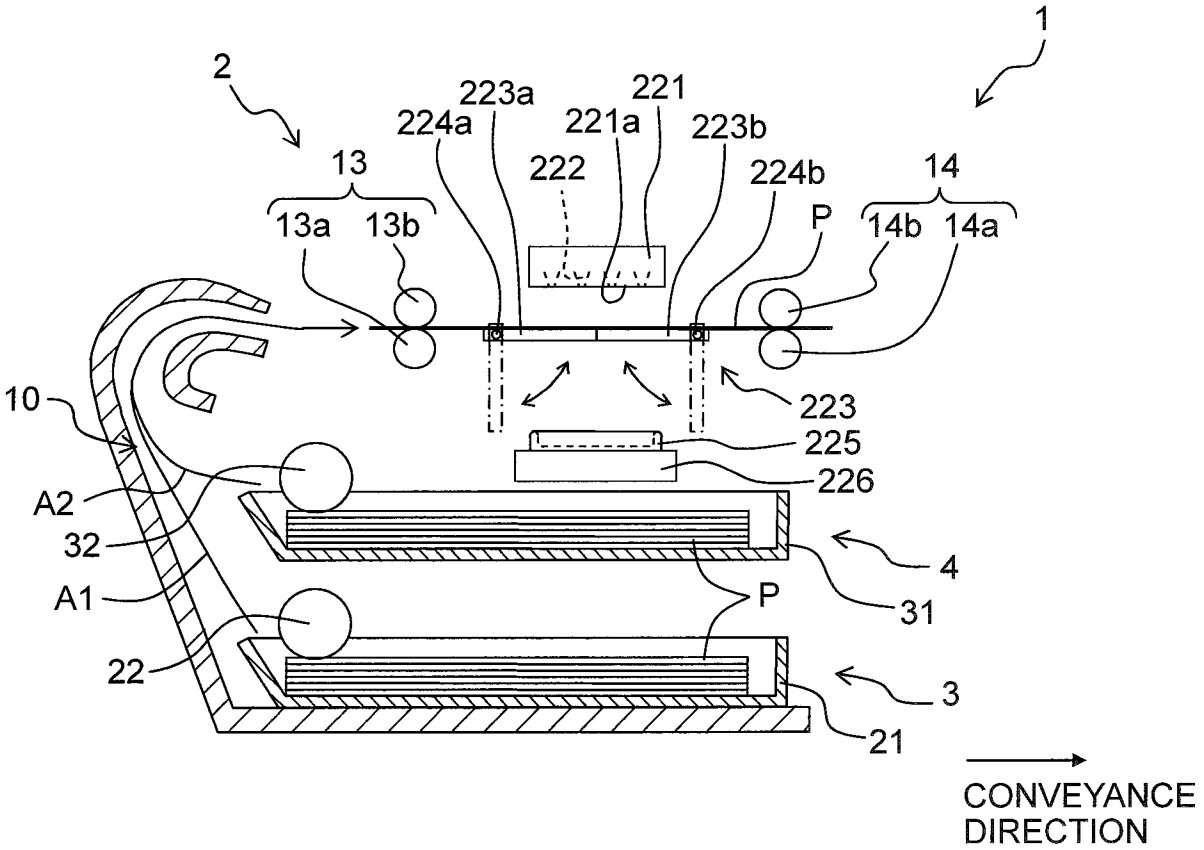
FIG. 23 is a diagram of a fourth modified embodiment corresponding to FIG. 1.

For example, in the fourth modified embodiment, as depicted in FIG. 23, an ink-jet head 221 is a so-called line head which extends across the recording sheet P in the scanning direction (a direction perpendicular to the sheet surface of FIG. 23). Ink is jetted from nozzles 222 formed in an ink jetting surface 221 a which is a lower surface of the ink-jet head 221. A platen 223 includes two plate-like members 223*a* and 223*b*. The plate-like member 223*a* is a rectangular member which is long in the scanning direction and is pivotally supported by a shaft 224*a*, which is disposed upstream of the ink-jet head 221 in the conveyance direction to extend in the scanning direction. The plate-like member 223*b*, which is a rectangular member similar to the plate-like member 223*a*, is pivotally supported by a shaft 224*b* which is disposed downstream of the ink-jet head 221 in the conveyance direction to extend in the scanning direction. The driving of an unillustrated motor allows the plate-like members 223*a* and 223*b* to pivot about the shafts 224*a* and 224*b* respectively.

In the fourth modified embodiment, a nozzle cap 225 is disposed below the platen 223. A cap lifting mechanism 226 moves the nozzle cap 225 up and down, for example, in a similar principle to the cap lifting mechanism 66. In this regard, since the nozzle cap 225 is different from the cap unit 61, for example, in size, the cap lifting mechanism 226 is also different from the cap lifting mechanism 66, for example, in sizes of respective members. Although illustration is omitted, a sensor which is similar to the sensor 79 of the above embodiment to detect the driving of the cap lifting mechanism 226 is provided in the fourth modified embodiment. The cap lifting mechanism 226 is connectable to the ASF motor 102 via the ASF switch gear 122 in a similar manner to the cap lifting mechanism 66. Rotating the ASF motor 102 normally with the cap lifting mechanism 226 being connected to the ASF motor 102 via the ASF switch gear 122 moves the nozzle cap 225 up and down.

In the fourth modified embodiment, during print, the plate-like members 223*a* and 223*b* are in a posture of facing the ink-jet head 221 as depicted by solid lines of FIG. 23. The plate-like members 223*a* and 223*b* support the recording sheet P from below, accordingly.

When the nozzle cap 225 covers the ink jetting surface 221*a*, for example, during maintenance, the plate-like members 223*a* and 223*b* in respective print positions are allowed to pivot 90° so as not to face the ink-jet head 221 as depicted by dashed-dotted lines of FIG. 23. Under this situation, the nozzle cap 225 is moved upward by the cap lifting mechanism 226 to make contact with the ink jetting surface 221 a.

In the fourth modified embodiment, when the ASF switch gear 122 switches from a state in which it is connected to the cap lifting mechanism 226 to a state in which it engages with the feed gear 131 to feed the recording sheet P from the lower cassette feed part 3, the switching may fail. When the ASF motor 102 is rotated normally with the ASF switch gear 122 erroneously connected to the cap lifting mechanism 226, the nozzle cap 225 is moved upward. This makes the plate-like members 223*a* and 223*b* contact with the nozzle cap 225, when the plate-like members 223*a* and 223*b* in the positions depicted by the solid lines of FIG. 23 are allowed to pivot to have the positions depicted by dashed-dotted lines of FIG. 23.

Thus, also in the fourth modified embodiment, the ASF motor 102 is stopped when the normal rotation of the ASF motor 102 switches the sensor from the off state to the on state after the ASF switch gear 122 switches from the state in which it is connected to the cap lifting mechanism 226 to the state in which it engages with the feed gear 131 to feed the recording sheet P from the lower cassette feed part 3, like the above embodiment. This prevents the nozzle cap 225 from moving upward.

In the above embodiment, the ASF motor 102 driving the feed rollers 22 and 32 is used to drive the cap lifting mechanism 66 and the switch valve 62. The present teaching, however, is not limited thereto. The cap lifting mechanism 66 and the switch valve 62 may be driven by a driven device different from the feed rollers 22 and 32, such as a motor for opening an unillustrated discharge tray cover.

In the above embodiment, the carriage 11 is moved first to switch the ASF switch gear 122 from the state in which it engages with the selective drive gear 137 to the state in which it engages with the feed gear 131. Then, the ASF motor 102 is stopped when the normal rotation of the ASF motor 102 switches the sensor 79 from the off state to the on state. After that, the carriage 11 is moved to the facing position. The present teaching, however, is not limited thereto.

Similar to the above embodiment, the strong engagement elimination operation in S111 may be performed after the ASF motor 102 is stopped in S109 without the movement of the carriage 11 to the facing position. In that case also, the cap unit 61 is prevented from reaching the capping position because the ASF motor 102 is stopped similarly to the above embodiment in S109.

In the embodiment, the ASF motor 102 is stopped when the normal rotation of the ASF motor 102 switches the sensor 79 from the off state to the on state after the movement of the carriage 11 switching the ASF switch gear 122 from the state in which it engages with the selective drive gear 137 to the state in which it engages with the feed gear 131. The present teaching, however, is not limited thereto.

Figure 24:
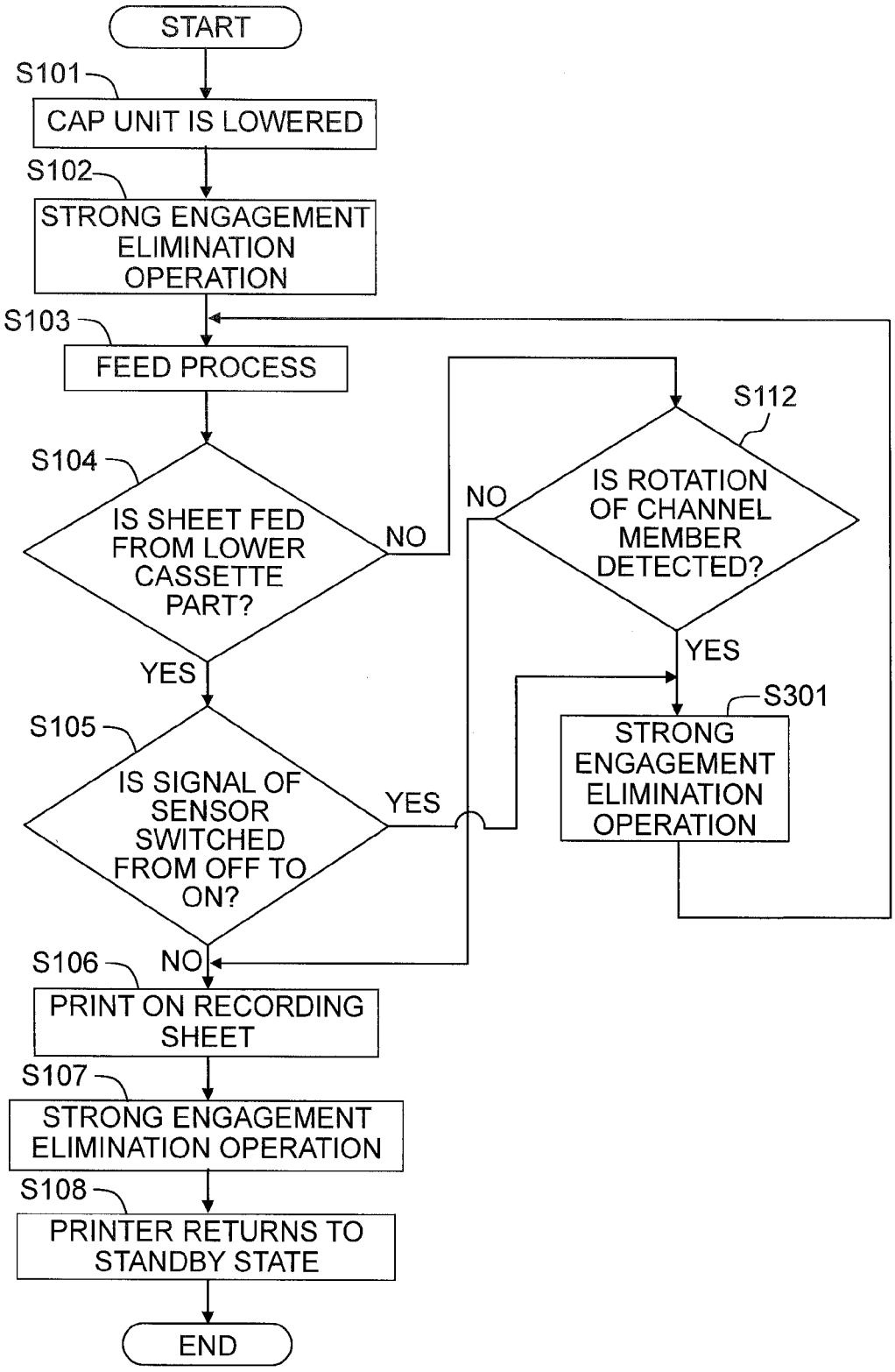
FIG. 24 is a flowchart of a fifth modified embodiment corresponding to FIG. 18.

In a fifth modified embodiment, as depicted in FIG. 24, when the sensor 79 switches from the off state to the on state in S105, and when the rotation of the channel member 82 is detected in S112, the strong engagement elimination operation is performed (S301) in which the ASF motor 102 is driven in different ways without stopping the ASF motor 102 to repeatedly rotate the ASF switch gear 122 in both directions by a minute angle. After completion of the strong engagement elimination operation, the process proceeds to S102.

In the strong engagement elimination operation in S301, the ASF motor 102 is reversely rotated first. The reverse rotation of the ASF motor 102 rotates the crank gear 73 in the direction which causes the cap unit 61 to move downward. Note that, to perform the strong engagement elimination operation, the normal rotation of the ASF motor 102 needs to be switched to the reverse rotation, which stops the rotation of the ASF motor 102 momentarily. Then, the ASF motor 102 is rotated normally to rotate the crank gear 73 in the direction which causes the cap unit 61 to move upward. In the strong engagement elimination operation, the crank gear 73 rotates alternately in the direction which causes the cap unit 61 to move downward and the direction which causes the cap unit 61 to move upward. Thus, the cap unit 61 is prevented from moving upward beyond the position at which the sensor 79 switches from the off state to the on state. The cap unit 61 is prevented from reaching the capping position, accordingly.

The strong engagement elimination operation in S301 eliminates the strong engagement between the ASF switch gear 122 and the selective drive gear 137. After that, the process returns to S102 to restart the print operation.

In the fifth modified embodiment, the reverse rotation of the ASF motor 102 is performed first in the strong engagement elimination operation of S301. The present teaching, however, is not limited thereto. The normal rotation of the ASF motor 102 may be performed first in the strong engagement elimination operation of S301. In that case, the normal rotation of the ASF motor 102 performed first rotates the crank gear 73 in the direction which causes the cap unit 61 to move upward. Thus, the cap unit 61 may move upward slightly beyond the position at which the sensor 79 switches from the off state to the on state. However, the reverse rotation of the ASF motor 102 performed thereafter rotates the crank gear 73 in the direction which causes the cap unit 61 to move downward. Namely, even when the cap unit 61 moves upward during the normal rotation of the ASF motor 102, the cap unit 61 moves downward during the reverse rotation of the ASF motor 102. At the completion of the strong engagement elimination operation, the cap unit 61 is positioned at the position at which the sensor 79 switches from the off state to the on state or the position which is slightly higher than the position at which the sensor 79 switches from the off state to the on state. The the cap unit 61 is prevented from reaching the capping position, accordingly.

The above description explains the examples in which the cap unit makes contact with the ink jetting surface to cover the nozzles in the capping position. The present teaching, however, is not limited thereto. Provided that the cap unit can cover the nozzles, the cap unit may make contact with other part than the ink jetting surface in the capping position.

The above description explains the examples in which the present teaching is applied to the printer which performs print by jetting ink from nozzles. The present teaching, however, is not limited thereto. The present teaching may be applied, in addition to the printer, to liquid jetting apparatuses jetting, from nozzles, liquid other than the ink.

What is claimed is:

1. A liquid jetting apparatus, comprising:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear configured to transmit the power which is generated by rotating the drive motor in the predetermined direction to the driven device;

a switch gear to which the power from the drive motor is transmitted, the switch gear being configured to be moved between a first position in which the switch gear engages with the first gear and a second position in which the switch gear engages with the second gear;

a gear movement device configured to move the switch gear;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and stop the drive motor in a case that the controller detects the driving of the cap movement device;

wherein the cap movement device includes:

a cam connected to the drive motor with the switch gear engaging with the first gear; and a slide part which is slidablv mounted to the cam, the slide part configured to be connected to the cap, and the cam includes:

a first surface on which the slide part slides and which extends in a direction having a component of the cap movement direction;

a second surface which is connected to the first surface, on which the slide part is positioned with the cap being in the uncapping position, and which is parallel to the liquid jetting surface; and a detection target configured to be moved from a non-detection position to a detection position in a case that the slide part is slid on the second surface toward the first surface, the non-detection position being a position in which the sensor outputs no signal, the detection position being a position in which the sensor outputs the signal.

2. The liquid jetting apparatus according to claim 1, wherein the controller is configured to continue to rotate the drive motor in the predetermined direction by a predetermined amount, in a case that the controller detects no driving of the cap movement device.

3. The liquid jetting apparatus according to claim 1, wherein, in a case that the drive motor rotates in the predetermined direction by a predetermined amount or more with the switch gear engaging with the first gear, the cap movement device starts to move the cap from the uncapping position toward the capping position in the cap movement direction, and the sensor is configured to output no signal in a case that the drive motor is rotated in the predetermined direction by less than the predetermined amount with the switch gear engaging with the first gear.

4. The liquid jetting apparatus according to claim 1, wherein the cap movement device includes:

a cap holding part having the slide part, the cap holding part holding the cap, the cap holding part configured to be moved in the cap movement direction; and the cam configured to be reciprocated in a slide direction intersecting with the cap movement direction by the drive motor, the first surface extends while being inclined with respect to the slide direction, the second surface extends parallel to the slide direction and the second surface includes a first part and a second part being closer to the first surface than the first part, the detection target is configured to be positioned in the non-detection position in a case that the slide part is positioned in the first part of the second surface, and the detection target is configured to be positioned in the detection position in a case that the slide part is positioned in the second part of the second surface.

5. The liquid jetting apparatus according to claim 4, wherein the cam further includes:

a third surface which is disposed more distant from the second surface than the first surface in the slide direction, which extends parallel to the slide direction, and on which the slide part is positioned with the cap being in the capping position;

a fourth surface which is disposed between the first surface and the third surface in the slide direction, connected to the third surface, and extends while being inclined with respect to the slide direction; and a fifth surface which is disposed between the second surface and the third surface in the cap movement direction and between the first surface and the fourth surface in the slide direction, extends parallel to the slide direction, and connects the first surface and the fourth surface, and in a case that the cam is moved such that the slide part slides across an area from the second surface to the fifth surface, the controller is configured to move the cam with reference to a position at which the signal is inputted from the sensor.

6. The liquid jetting apparatus according to claim 1, wherein the head unit includes a liquid jetting head with the liquid jetting surface and a carriage which carries the liquid jetting head, the liquid jetting apparatus further comprises a carriage motor configured to move the carriage in a scanning direction parallel to the liquid jetting surface, and under a condition that the controller drives the gear movement device such that the switch gear moves from the first position to the second position and then rotates the drive motor in the predetermined direction, and in a case that the controller detects the driving of the cap movement device, the controller is configured to stop the drive motor and to control the carriage motor to move the carriage to a facing position where the liquid jetting surface faces the cap.

7. A liquid jetting apparatus, comprising:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear configured to transmit the power which is generated by rotating the drive motor in the predetermined direction to the driven device;

a switch gear to which the power from the drive motor is transmitted, the switch gear being configured to be moved between a first position in which the switch gear engages with the first gear and a second position in which the switch gear engages with the second gear;

a gear movement device configured to move the switch gear;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and stop the drive motor in a case that the controller detects the driving of the cap movement device;

wherein the cap movement device includes:

a cam configured to be reciprocated in a slide direction intersecting with the cap movement direction by the drive motor with the switch gear engaging with the first gear; and a cap holding part holding the cap, the cap holding part configured to be moved in the cap movement direction, the cap holding part having a slide part which is slidably mounted to the cam, the cam includes:

a first surface on which the slide part slides and which extends in a direction having a component of the cap movement direction;

a second surface which is connected to the first surface, on which the slide part is positioned with the cap being in the uncapping position, and which is parallel to the liquid jetting surface; and a detection target configured to be moved from a non-detection section to a detection section in a case that the slide part is slid on the second surface toward the first surface, the non-detection section being a section in which the sensor outputs no signal, the detection section being a section in which the sensor outputs the signal, and the non-detection section has a length in the slide direction which is shorter than a length of the second surface in the slide direction.

8. A liquid jetting apparatus, comprising:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear configured to transmit the power which is generated by rotating the drive motor in the predetermined direction to the driven device;

a switch gear to which the power from the drive motor is transmitted, the switch gear being configured to be moved between a first position in which the switch gear engages with the first gear and a second position in which the switch gear engages with the second gear;

a gear movement device configured to move the switch gear;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and stop the drive motor in a case that the controller detects the driving of the cap movement device;

wherein the driven device includes a first sheet supply device configured to supply a first sheet and a second sheet supply device configured to supply a second sheet different from the first sheet, the power of the drive motor is transmitted to the first sheet supply device in a case that the drive motor rotates in the predetermined direction with the switch gear engaging with the second gear, and the power of the drive motor is transmitted to the second sheet supply device in a case that the drive motor rotates in a direction opposite to the predetermined direction with the switch gear engaging with the second gear;

wherein the second gear includes:

a first sheet supply gear configured to transmit, to the first sheet supply device, the power which is generated by rotating the drive motor in the predetermined direction and a second sheet supply gear configured to transmit, to the second sheet supply device, the power which is generated by rotating the drive motor in the direction opposite to the predetermined direction, and the switch gear is configured to move between the first position and a position at which the switch gear engages with the first sheet supply gear and a position at which the switch gear engages with the second sheet supply gear.

9. A liquid jetting apparatus, comprising:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear disposed side by side with the first gear in a scanning direction and configured to transmit the power which is generated by rotating the drive motor in the predetermined direction to the driven device;

a switch gear to which the power from the drive motor is transmitted, the switch gear being configured to be moved, in the scanning direction, between a first position in which the switch gear engages with the first gear and a second position in which the switch gear engages with the second gear;

a gear movement device configured to move the switch gear in the scanning direction;

a sensor configured to output a signal according to driving of the cap movement device; and a controller, wherein the controller is configured to:

detect driving of the cap movement device based on the signal inputted from the sensor after the cap movement device is driven and before the cap reaches the capping position, under a condition that the controller drives the gear movement device such that the switch gear moves from the first position to the second position and then rotates the drive motor in the predetermined direction; and rotate the drive motor in the predetermined direction and a direction opposite to the predetermined direction repeatedly and alternately to eliminate strong engagement between the switch gear and the first gear, in a case that the controller detects the driving of the cap movement device;

wherein the cap movement device includes:

a cam connected to the drive motor with the switch gear engaging with the first gear; and a slide part which is slidably mounted to the cam, the slide part configured to be connected to the cap, and the cam includes:

a first surface on which the slide part slides and which extends in a direction having a component of the cap movement direction;

a second surface which is connected to the first surface, on which the slide part is positioned with the cap being in the uncapping position, and which is parallel to the liquid jetting surface; and a detection target configured to be moved from a non-detection position to a detection position in a case that the slide part is slid on the second surface toward the first surface, the non-detection position being a position in which the sensor outputs no signal, the detection position being a position in which the sensor outputs the signal.

10. The liquid jetting apparatus according to claim 9, wherein the controller is configured to continue to rotate the drive motor in the predetermined direction by a predetermined amount, in a case that the controller detects no driving of the cap movement device.

11. A liquid jetting apparatus, comprising:

a head unit including nozzles and a liquid jetting surface with the nozzles;

a cap configured to be moved, between a capping position in which the cap is in contact with the head unit to cover the nozzles and an uncapping position in which the cap is separated from the head unit, in a cap movement direction intersecting with the liquid jetting surface;

a cap movement device configured to make the cap reciprocate in the cap movement direction;

a driven device;

a drive motor configured to drive the cap movement device and the driven device;

a first gear configured to transmit power which is generated by rotating the drive motor in a predetermined direction to the cap movement device;

a second gear configured to transmit the power which is generated by rotating the drive motor in the predetermined direction to the driven device;

a switch gear to which the power from the drive motor is transmitted, the switch gear being configured to be moved between a first position in which the switch gear engages with the first gear and a second position in which the switch gear engages with the second gear;

a gear movement device configured to move the switch gear;

a sensor configured to output a signal according to driving of the cap movement device; and a controller, wherein the controller is configured to:

in a case of moving the cap between the capping position and the uncapping position with the switch gear being at the first position, rotate the drive motor to move the cap until the signal outputted from the sensor is received, and further rotate the drive motor by a predetermined amount to move the cap after the signal outputted from the sensor is received; and under a condition that the controller rotates the drive motor in the predetermined direction after moving the switch gear from the first position to the second position, stop the drive motor in a case of receiving the signal outputted from the sensor before the cap reaches the capping position.

12. The liquid jetting apparatus according to claim 1, further comprising a carriage which carries the liquid jetting head and a carriage motor configured to move the carriage in a scanning direction parallel to the liquid jetting surface, wherein the gear movement device includes the carriage and the gear movement device is configured to move the switch gear in response to movement of the carriage.

* * * * *